US008956798B2

(12) United States Patent
Sata et al.

(10) Patent No.: US 8,956,798 B2
(45) Date of Patent: Feb. 17, 2015

(54) PROCESS FOR PRODUCING TONER FOR ELECTROPHOTOGRAPHY

(75) Inventors: Shinichi Sata, Wakayama (JP); Takehiro Tsutsumi, Wakayama (JP); Hiroshi Mizuhata, Wakayama (JP)

(73) Assignee: Kao Corporation, Tokyo (JP)

( * ) Notice: Subject to any disclaimer, the term of this patent is extended or adjusted under 35 U.S.C. 154(b) by 737 days.

(21) Appl. No.: 13/054,257

(22) PCT Filed: Jul. 15, 2009

(86) PCT No.: PCT/JP2009/062779

§ 371 (c)(1), (2), (4) Date: Mar. 30, 2011

(87) PCT Pub. No.: WO2010/008007

PCT Pub. Date: Jan. 21, 2010

(65) Prior Publication Data

US 2011/0183249 A1 Jul. 28, 2011

(30) Foreign Application Priority Data

Jul. 16, 2008 (JP) ..... 2008-185358

(51) Int. Cl.

*G03G 9/087* (2006.01)
*G03G 9/08* (2006.01)
*G03G 9/09* (2006.01)

(52) U.S. Cl.

CPC ..... *G03G 9/08711* (2013.01); *G03G 9/0804* (2013.01); *G03G 9/0806* (2013.01); *G03G 9/08791* (2013.01); *G03G 9/08795* (2013.01); *G03G 9/08797* (2013.01); *G03G 9/09* (2013.01)

USPC ..... 430/137.17; 430/109.3; 430/137.14

(58) Field of Classification Search

USPC ..... 430/109.3, 137.12, 137.14, 137.17

See application file for complete search history.

(56) References Cited

U.S. PATENT DOCUMENTS

| | | | | |
|---|---|---|---|---|
| 5,298,356 | A * | 3/1994 | Tyagi et al. | 430/109.3 |
| 2002/0039699 | A1 | 4/2002 | Nishimori et al. | |
| 2006/0030640 | A1* | 2/2006 | Tsuru et al. | 523/160 |
| 2006/0063084 | A1* | 3/2006 | Sweeney et al. | 430/108.7 |
| 2006/0093935 | A1 | 5/2006 | Ono et al. | |
| 2007/0020550 | A1* | 1/2007 | Kamoto | 430/109.4 |
| 2007/0099106 | A1 | 5/2007 | Ueda et al. | |
| 2007/0184375 | A1* | 8/2007 | Ninomiya et al. | 430/108.21 |
| 2007/0259282 | A1 | 11/2007 | Ishidai et al. | |
| 2007/0299198 | A1* | 12/2007 | Spinelli | 524/543 |
| 2008/0026311 | A1* | 1/2008 | Mizuhata et al. | 430/113 |
| 2008/0233508 | A1* | 9/2008 | Kamiyoshi et al. | 430/110.3 |
| 2011/0014564 | A1* | 1/2011 | Moffat et al. | 430/137.11 |

FOREIGN PATENT DOCUMENTS

| | | | |
|---|---|---|---|
| EP | 1 757 992 | A2 | 2/2007 |
| JP | 08-020636 | A | 1/1996 |
| JP | 10-239903 | A | 9/1998 |
| JP | 11-133668 | A | 5/1999 |
| JP | 2002 116574 | | 4/2002 |
| JP | 2003 316079 | | 11/2003 |
| JP | 2003-316079 | A | 11/2003 |
| JP | 2004 271585 | | 9/2004 |
| JP | 2005 275145 | | 10/2005 |
| JP | 2005-275145 | A | 10/2005 |
| JP | 2006 171692 | | 6/2006 |
| JP | 2006-171692 | A | 6/2006 |
| JP | 2007 192865 | | 8/2007 |
| JP | 2008 89908 | | 4/2008 |

OTHER PUBLICATIONS

Extended European Search Report issued Dec. 5, 2012, in European Patent Application No. 09797932.2.

International Search Report issued Aug. 18, 2009 in PCT/JP09/062779 filed Jul. 15, 2009.

Office Action issued May 8, 2012 in Japanese Patent Application No. 2008-185358 (with English translation).

* cited by examiner

*Primary Examiner* — Jonathan Jelsma

(74) *Attorney, Agent, or Firm* — Oblon, Spivak, McClelland, Maier & Neustadt, L.L.P.

(57) ABSTRACT

The present invention relates to a process for producing a toner for electrophotography which is excellent in dispersibility of a colorant in the toner and capable of considerably improving an image density, as well as a toner for electrophotography which is produced by the process. There is provided a process for producing a toner for electrophotography which includes the step of mixing a dispersion of colorant-containing polymer particles with a dispersion of resin particles containing substantially no colorant to aggregate the colorant-containing polymer particles and the resin particles, wherein the polymer contains a constitutional unit derived from a salt-forming group-containing monomer (a) and a constitutional unit derived from an aromatic ring-containing monomer (b).

19 Claims, No Drawings

PROCESS FOR PRODUCING TONER FOR ELECTROPHOTOGRAPHY

CROSS REFERENCE TO RELATED APPLICATION

This application is a 371 of PCT/JP09/062779, filed on Jul. 15, 2009, and claims priority to Japanese Patent Application No. 2008-185358, filed on Jul. 16, 2008.

FIELD OF THE INVENTION

The present invention relates to a toner for electrophotography for use in electrophotographic method, electrostatic recording method, electrostatic printing method or the like, and a process for producing the toner.

BACKGROUND OF THE INVENTION

In the field of toners for electrophotography, with the progress of electrophotographic systems, it has been demanded to develop toners adaptable for high image quality and high printing speed. From the viewpoint of the high image quality, it has been required that colorants used in the toners are in the form of finely divided particles. However, the colorants are hardly dispersed in the toners, thereby causing problems such as deteriorated image density.

In recent years, so-called chemical prepared toners have been used because of a small particle size and a narrow particle size distribution thereof. However, it tends to be difficult to apply a mechanical shear force to the chemical prepared toners when dispersed unlike so-called pulverized toners, so that a pigment fails to be well dispersed therein, which results in difficulty in attaining a high image density.

As to the chemical prepared toners, there are disclosed, for example, the technique using a self-dispersible pigment (Patent Document 1), the toner produced from a pigment dispersion prepared by dispersing a pigment using a surfactant as a dispersant (Patent Document 2), etc. In addition, there is also known the method in which a kneaded material obtained by previously melt-kneading a resin and a colorant is emulsified (Patent Document 3). However, this method tends to be deteriorated in productivity owing to an increased number of production steps, and further the colorant tends to be poor in dispersibility in the resin. Therefore, there is an increasing demand for toners capable of forming images having a sufficient density.

Patent Document 1: JP-A 2005-275145
Patent Document 2: JP-A 2003-316079
Patent Document 3: JP-A 2006-171692

SUMMARY OF THE INVENTION

As described above, the chemical prepared toners tend to be deteriorated in color developability and density of the resulting toner images owing to a poor dispersibility of a colorant therein. As a result, it is required that an amount of the colorant used in the chemical prepared toners is increased as compared to that used in the pulverized toners.

The present invention relates to a process for producing a toner for electrophotography which is excellent in dispersibility of a colorant therein and capable of considerably improving an image density even when the colorant is used in a small amount, as well as a toner for electrophotography which is produced by the process.

Thus, the present invention relates to:

(1) A process for producing a toner for electrophotography, including the step of mixing a dispersion of colorant-containing polymer particles with a dispersion of resin particles containing substantially no colorant to aggregate the colorant-containing polymer particles and the resin particles, wherein a polymer constituting the colorant-containing polymer particles contains a constitutional unit derived from a salt-forming group-containing monomer (a) and a constitutional unit derived from an aromatic ring-containing monomer (b).

(2) A toner for electrophotography which is produced by the process as described in the above (1).

EFFECT OF THE INVENTION

In accordance with the production process of the present invention, it is possible to obtain a toner for electrophotography which is improved in dispersibility of a colorant therein and therefore is capable of considerably enhancing an image density even when the colorant is used in a small amount.

DETAILED DESCRIPTION OF THE INVENTION

[Process for Producing Toner for Electrophotography]

The process for producing a toner for electrophotography according to the present invention includes the step of mixing a dispersion of colorant-containing polymer particles with a dispersion of resin particles containing substantially no colorant to aggregate the colorant-containing polymer particles and the resin particles, wherein a polymer constituting the colorant-containing polymer particles contains a constitutional unit derived from a salt-forming group-containing monomer (a) and a constitutional unit derived from an aromatic ring-containing monomer (b).

In the process for producing a toner for electrophotography according to the present invention, the colorant-containing polymer particles which contain a polymer having a specific structure and a colorant are used. That is, in the above constitutional units of the polymer constituting the colorant-containing polymer particles, the above component (a) serves as a dispersant owing to its electric repulsion property, whereas the above component (b) is adsorbed to the colorant. As a result, it is considered that since the colorant is hardly aggregated together and therefore improved in dispersibility, the resulting toner is capable of attaining a high image density owing to enhanced dispersibility of a pigment therein.

More specifically, since the colorant is enclosed in the polymer having the water-dispersible ionic moiety and the aromatic ring-containing moiety capable of being adsorbed to a pigment, the dispersibility of the colorant in the dispersion of the colorant-containing polymer particles can be drastically improved. As a result, when the colorant-containing polymer particles and the resin particles in the resin binder dispersion are aggregated and coalesced together to produce a toner, the resulting toner can exhibit a high color developability.

(Dispersion of Colorant-Containing Polymer Particles)

Colorant

The colorant used in the present invention may be either a hydrophobic dye or a pigment, or may be a mixture prepared by using both thereof in an arbitrary mixing ratio.

The pigment may be either organic or inorganic. The organic or inorganic pigment may be used in combination with an extender pigment, if required.

Examples of the organic pigments include azo pigments, disazo pigments, phthalocyanine pigments, quinacridone pigments, isoindolinone pigments, dioxazine pigments, perylene pigments, perinone pigments, thioindigo pigments, anthraquinone pigments and quinophthalone pigments.

Specific examples of the preferred organic pigments include Color Index (C.I.) Pigment Yellow 13, 17, 74, 83, 97, 109, 110, 120, 128, 139, 151, 154, 155, 174, 180; C.I. Pigment Red 48, 57:1, 122, 146, 176, 184, 185, 188, 202; C.I. Pigment Violet 19, 23; C.I. Pigment Blue 15, 15:1, 15:2, 15:3, 15:4, 16, 60; and C.I. Pigment Green 7, 36.

Examples of the inorganic pigments include carbon blacks, metal oxides, metal sulfides and metal chlorides. Among these inorganic pigments, carbon blacks are especially preferably used as a black pigment. The carbon blacks may include furnace blacks, thermal lamp blacks, acetylene blacks and channel blacks.

Examples of the extender pigment include silica, calcium carbonate and talc.

As the dye, hydrophobic dyes are preferably used because they can easily become contained in the polymer. Examples of the hydrophobic dyes include oil dyes and disperse dyes. To allow the dye to efficiently become contained in the polymer, the solubility of the hydrophobic dye in an organic solvent is preferably 2 g/L or higher and more preferably from 20 to 500 g/L as measured at 25° C. based on the organic solvent to be used for dissolving the hydrophobic dye upon the production of the dispersion of the colorant-containing polymer particles.

Examples of the oil dyes include C.I. Solvent Black 3, 7, 27, 29, 34, 45; C.I. Solvent Yellow 14, 16, 29, 56, 82, 83:1; C.I. Solvent Red 1, 3, 8, 18, 24, 27, 43, 49, 51, 72, 73; C.I. Solvent Violet 3; C.I. Solvent Blue 2, 4, 11, 44, 64, 70; C.I. Solvent Green 3, 7; and C.I. Solvent Orange 2. In addition, there may also be used commercially available oil dyes and disperse dyes.

Among these oil and disperse dyes, preferred are C.I. Solvent Yellow 29 and 30 for a yellow colorant, C.I. Solvent Blue 70 for a cyan colorant, C.I. Solvent Red 18 and 49 for a magenta colorant, and C.I. Solvent Black 3 and 7 and nigrosine black dyes for a black colorant.

From the viewpoint of enhancing a dispersibility of the colorant-containing polymer particles, an image density, etc., the content of the colorant in the dispersion of the colorant-containing polymer particles is preferably from 1 to 30% by weight and more preferably from 3 to 20% by weight.

From the viewpoints of a high image density and a good tribocharge property of the resulting toner, the weight ratio between the polymer constituting the colorant-containing polymer particles and the colorant which are used in the present invention may be controlled such that the colorant is preferably used in an amount of from 20 to 1,000 parts by weight, more preferably from 50 to 900 parts by weight, still more preferably from 100 to 800 parts by weight and further still more preferably from 200 to 800 parts by weight on the basis of 100 parts by weight of solid components of the polymer.

Polymer Constituting Colorant-Containing Polymer Particles

The polymer constituting the colorant-containing polymer particles (hereinafter occasionally referred to as a "water-insoluble polymer") contains a main chain which is a polymer chain containing a constitutional unit derived from a salt-forming group-containing monomer (a) and a constitutional unit derived from an aromatic ring-containing monomer (b), and preferably further contains a side chain which is a polymer chain containing a constitutional unit derived from a hydrophobic monomer (c) from the viewpoint of a good dispersibility of the colorant-containing polymer particles. In addition, the water-insoluble polymer may also contain side chains containing other constitutional units.

The water-insoluble polymer is preferably a vinyl polymer in view of enhancing a stability of the resulting dispersion.

The constitutional unit derived from the salt-forming group-containing monomer (a) which is contained in the main chain is considered to serve as a dispersant owing to an electric repulsion property thereof. The constitutional unit derived from the salt-forming group-containing monomer (a) is preferably produced by polymerizing the salt-forming group-containing monomer. After completion of the polymerization, salt-forming groups such as anionic groups and cationic groups may be introduced into the resulting polymer chain.

The constitutional unit derived from the salt-forming group-containing monomer is used for enhancing a dispersion stability of the polymer. Examples of the salt-forming group include anionic groups such as a carboxyl group, a sulfonic group and a phosphoric group, and cationic groups such as an amino group and an ammonium group.

Examples of the preferred salt-forming group-containing monomer used for forming the constitutional unit derived from the salt-forming group-containing monomer (a) include anionic monomers (a-1) and cationic monomers (a-2).

As the anionic monomer (a-1), there may be used at least one compound selected from the group consisting of unsaturated carboxylic acid monomers, unsaturated sulfonic acid monomers and unsaturated phosphoric acid monomers.

Examples of the unsaturated carboxylic acid monomers include acrylic acid, methacrylic acid, crotonic acid, itaconic acid, maleic acid, fumaric acid, citraconic acid and 2-methacryloyloxymethylsuccinic acid.

Examples of the unsaturated sulfonic acid monomers include styrenesulfonic acid, 2-acrylamido-2-methylpropanesulfonic acid, 3-sulfopropyl(meth)acrylic acid ester and bis(3-sulfopropyl)itaconic acid ester.

Examples of the unsaturated phosphoric acid monomers include vinyl phosphonic acid, vinyl phosphate, bis(methacryloxyethyl)phosphate, diphenyl-2-acryloyloxyethyl phosphate, diphenyl-2-methacryloyloxyethyl phosphate and dibutyl-2-acryloyloxyethyl phosphate.

Among the above anionic monomers, from the viewpoints of a high image density and a good tribocharge property of the resulting toner, preferred are the unsaturated carboxylic acid monomers, and more preferred are acrylic acid and methacrylic acid.

As the cationic monomer (a-2), there may be used at least one compound selected from the group consisting of unsaturated tertiary amine-containing vinyl monomers and unsaturated ammonium salt-containing vinyl monomers.

Examples of the unsaturated tertiary amine-containing vinyl monomers include N,N-dimethylaminoethyl(meth)acrylate, N,N-dimethylaminopropyl(meth)acrylate, N,N-diethylaminoethyl(meth)acrylate, N,N-dimethylaminopropyl(meth)acrylamide, vinyl pyrrolidone, 2-vinyl pyridine, 4-vinyl pyridine, 2-methyl-6-vinyl pyridine and 5-ethyl-2-vinyl pyridine.

Examples of the unsaturated ammonium salt-containing vinyl monomers include quaternary ammonium compounds derived from N,N-dimethylaminoethyl(meth)acrylate, quaternary ammonium compounds derived from N,N-diethylaminoethyl(meth)acrylate, and quaternary ammonium compounds derived from N,N-dimethylaminopropyl(meth)acrylate.

Among the above cationic monomers, preferred are N,N-dimethylaminoethyl(meth)acrylate, N,N-dimethylaminopropyl(meth)acrylamide and vinyl pyrrolidone.

Meanwhile, the term "(meth)acrylate" as used herein means an "acrylate", a "methacrylate" or a mixture thereof.

These salt-forming group-containing monomers may be used alone or in combination of any two or more thereof.

The constitutional unit derived from the aromatic ring-containing monomer (b) is considered to mainly exhibit the effect of suppressing aggregation between particles of the colorant. It is considered that when the constitutional unit derived from the aromatic ring-containing monomer (b) is used in combination with the constitutional unit derived from the salt-forming group-containing monomer (a), a dispersibility of the colorant in the polymer is enhanced, and a tribocharge property of the toner as well as an image density thereof are also enhanced owing to inclusion of the aromatic ring in the polymer. As the aromatic ring-containing monomer, there are preferably used aromatic ring-containing (meth)acrylate monomers. Examples of the preferred constitutional unit derived from the aromatic ring-containing monomer include those constitutional units represented by the following formula (1):

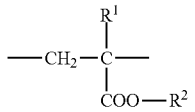

(1)

wherein $R^1$ is a hydrogen atom or a methyl group; and $R^2$ is a substituted or unsubstituted aralkyl group having 7 to 22 carbon atoms or a substituted or unsubstituted aryl group having 6 to 22 carbon atoms.

In the formula (1), $R^2$ is a substituted or unsubstituted aralkyl group having 7 to 22 carbon atoms, preferably 7 to 18 carbon atoms and more preferably 7 to 12 carbon atoms, or a substituted or unsubstituted aryl group having 6 to 22 carbon atoms, preferably 6 to 18 carbon atoms and more preferably 6 to 12 carbon atoms.

Specific examples of $R^2$ include a benzyl group, a phenethyl group (phenylethyl group), a phenoxyethyl group, a diphenylmethyl group and a trityl group.

The substituent groups which may be bonded to the aralkyl group or aryl group may contain hetero atoms. Examples of the hetero atoms include a nitrogen atom, an oxygen atom and a sulfur atom.

Specific examples of the substituent groups for the aralkyl group or aryl group include alkyl, alkoxy and acyloxy groups each preferably having 1 to 9 carbon atoms, a hydroxyl group, an ether group, an ester group and a nitro group.

The constitutional unit represented by the formula (1) is preferably produced by polymerizing a monomer represented by the following formula (1-1):

$$CH_2{=}CR^1COOR^2 \quad (1\text{-}1)$$

wherein $R^1$ and $R^2$ are the same as defined above.

More specifically, the constitutional unit represented by the formula (1) may be produced by polymerizing a monomer such as phenyl(meth)acrylate, benzyl(meth)acrylate, 2-phenylethyl(meth)acrylate, phenoxyethyl(meth)acrylate, 1-naphthalyl acrylate, 2-naphthalyl(meth)acrylate, phthalimidemethyl(meth)acrylate, p-nitrophenyl(meth)acrylate, 2-hydroxy-3-phenoxypropyl(meth)acrylate, 2-methacryloyloxyethyl-2-hydroxypropyl phthalate, 2-acryloyloxyethyl phthalic acid, etc. Among these monomers, from the viewpoints of a high image density and a good tribocharge property of the resulting toner, preferred is benzyl(meth)acrylate. These monomers may be used alone or in combination of any two or more thereof.

From the viewpoint of enhancing an image density and a storage stability of the toner, etc., the main chain may also contain a constitutional unit derived from a (meth)acrylate containing an alkyl group having 1 to 22 carbon atoms, or a monomer represented by the following formula (2) (hereinafter these monomers are generally referred to merely a "hydrophobic monomer (e)"):

$$CH_2{=}C(R^3){-}R^4 \quad (2)$$

wherein $R^3$ is a hydrogen atom or an alkyl group having 1 to 5 carbon atoms; and $R^4$ is an aromatic ring-containing hydrocarbon group having 6 to 22 carbon atoms, More specifically, the constitutional unit derived from a (meth)acrylate containing an alkyl group having 1 to 22 carbon atoms may be produced by polymerizing a monomer such as methyl(meth)acrylate, ethyl(meth)acrylate, (iso)propyl(meth)acrylate, (iso- or tertiary-)butyl(meth)acrylate, 2-ethylhexyl(meth)acrylate, (iso)octyl(meth)acrylate, (iso)decyl(meth)acrylate, (iso)dodecyl(meth)acrylate, (iso)stearyl(meth)acrylate and behenyl(meth)acrylate. Meanwhile, the terms "(iso- or tertiary-)" and "(iso)" as used herein mean both a branched structure represented by "iso" or "tertiary", and an unbranched structure (i.e., "normal").

In the formula (2), $R^3$ is preferably a hydrogen atom or a methyl group. As the monomer represented by the formula (2), in view of a high image density, etc., there is preferably used at least one compound selected from the group consisting of styrene, vinyl naphthalene, α-methyl styrene, vinyl toluene, ethyl vinyl benzene, 4-vinyl biphenyl and 1,1-diphenyl ethylene. Among these compounds, in view of a high image density and a good storage stability of the toner, etc., preferred is at least one styrene-based monomer selected from the group consisting of styrene, α-methyl styrene and vinyl toluene.

The main chain preferably further contains a constitutional unit derived from a nonionic (meth)acrylate-based monomer (d) in view of enhancing an image density of the toner, etc.

The nonionic (meth)acrylate-based monomer is preferably a nonionic monomer represented by the following formula (3) from the viewpoint of a high image density of the toner:

$$CH_2{=}C(R^5)COO(R^6O)_nR^7 \quad (3)$$

wherein $R^5$ is a hydrogen atom or an alkyl group having 1 to 3 carbon atoms; $R^6$ is an alkylene group having 2 to 18 carbon atoms; n represents an average molar number of addition and is a number of 1 to 30; and $R^7$ is preferably a hydrogen atom, an alkyl group having 1 to 18 carbon atoms or a phenyl group which may be substituted with an alkyl group having 1 to 8 carbon atoms.

In the formula (3), in view of a good polymerizability, etc., $R^5$ is preferably a hydrogen atom, a methyl group, etc., and $R^6$ is preferably an alkylene group having 2 to 4 carbon atoms such as an ethylene group, a propylene group and a tetramethylene group. More specifically, $R^6$ is preferably an ethylene group in view of enhancing a dispersibility of the colorant-containing polymer particles, and a propylene group or a tetramethylene group in view of enhancing an image density of the toner. The suffix n is preferably a number of 2 to 25 and more preferably 4 to 23 in view of a high image density and a good storage stability of the toner, etc. If the suffix n is a number of 2 or more, a plurality of the $R^6$ groups may be the same or different. If the $R^6$ groups in the number of n are different from each other, the $R^6$ groups may be bonded to each other in any manner of block bonding and random bonding.

In view of a high image density and a good storage stability of the toner, etc., $R^7$ is preferably an alkyl group having 1 to 12 carbon atoms and more preferably an alkyl group having 1 to 8 carbon atoms, or preferably a phenyl group which may be substituted with an alkyl group having 1 to 8 carbon atoms.

Examples of the alkyl group having 1 to 8 carbon atoms include methyl, ethyl, propyl, isopropyl, butyl, tert-butyl, hexyl, octyl and 2-ethylhexyl groups.

Specific examples of the nonionic monomer represented by the formula (3) include hydroxyethyl methacrylate, methoxy polyethylene glycol mono(meth)acrylate; polyethylene glycol mono(meth)acrylate; methoxy polypropylene glycol mono(meth)acrylate; polypropylene glycol mono(meth) acrylate; ethylene glycol/propylene glycol(meth)acrylate; poly(ethylene glycol/propylene glycol)mono(meth)acrylate; and octoxy-polyethylene glycol/polypropylene glycol mono (meth)acrylate. From the viewpoints of a high image density and a good tribocharge property of the toner, among these nonionic monomers, preferred are polyethylene glycol mono (meth)acrylate and polypropylene glycol mono(meth)acrylate, and more preferred is polypropylene glycol mono(meth) acrylate. These nonionic monomers may be used alone or in combination of any two or more thereof.

The weight ratio of the constitutional unit derived from the salt-forming group-containing monomer (a) (calculated as a non-neutralized monomer; hereinafter calculated in the same way) to the constitutional unit derived from the aromatic ring-containing monomer (b) [(a)/(b)] in the main chain is preferably from 1/1 to 1/20, more preferably from 1/1.5 to 1/15 and still more preferably from 1/2 to 1/10 from the viewpoints of a good dispersibility of the colorant-containing polymer particles, a high image density and a good tribocharge property of the toner.

The content of the constitutional unit derived from the salt-forming group-containing monomer (a) in the main chain is preferably from 3 to 30% by weight, more preferably from 3 to 20% by weight, still more preferably from 5 to 20% by weight and further still more preferably from 5 to 15% by weight on the basis of the weight of the water-insoluble polymer from the viewpoint of enhancing a dispersibility of the water-insoluble polymer.

The content of the constitutional unit derived from the aromatic ring-containing monomer (b) in the main chain is preferably from 10 to 80% by weight, more preferably from 15 to 80% by weight, still more preferably from 20 to 70% by weight and further still more preferably from 20 to 65% by weight from the viewpoints of a good dispersibility of the colorant-containing polymer particles, a high image density and a good tribocharge property of the toner.

The content of the constitutional unit derived from the hydrophobic monomer (e) in the main chain is preferably from 0 to 40% by weight and more preferably from 0 to 20% by weight on the basis of the weight of the water-insoluble polymer from the viewpoint of enhancing a dispersibility of the colorant-containing polymer particles, an image density of the toner.

The content of the constitutional unit derived from the (meth)acrylate containing an alkyl group having 1 to 22 carbon atoms in the main chain is preferably from 0 to 10% by weight and more preferably from 0 to 5% by weight on the basis of the weight of the water-insoluble polymer from the viewpoint of enhancing a dispersion stability of the colorant-containing polymer particles. The content of the constitutional unit derived from the monomer represented by the above formula (2) in the main chain is preferably from 0 to 30% by weight and more preferably from 0 to 15% by weight on the basis of the weight of the water-insoluble polymer from the viewpoint of enhancing an image density.

Further, the content of the constitutional unit derived from the nonionic (meth)acrylate-based monomer (d) in the main chain is preferably from 0 to 60% by weight, more preferably from 10 to 50% by weight, still more preferably from 10 to 40% by weight and further still more preferably from 10 to 30% by weight from the viewpoint of enhancing an image density.

The water-insoluble polymer used in the present invention preferably contains a constitutional unit derived from a hydrophobic monomer (c) in a side chain thereof from the viewpoints of well incorporating a sufficient amount of the colorant in the polymer particles and enhancing an image density (the water-insoluble polymer containing the constitutional unit derived from the hydrophobic monomer (c) in a side chain is hereinafter occasionally referred to merely as a "water-insoluble graft polymer").

Examples of the hydrophobic monomer which is used for forming the constitutional unit derived from the hydrophobic monomer (c) include vinyl monomers. Specific examples of the hydrophobic monomer include the following monomers (c-1) to (c-3).

(c-1) Styrene-Based Monomers;

Examples of the styrene-based monomers include styrene, α-methyl styrene and vinyl toluene. Among these styrene-based monomers, preferred is styrene from the viewpoint of enhancing a dispersibility of the colorant-containing polymer particles, an image density. The side chain containing the constitutional unit derived from the styrene-based monomer may be produced by copolymerizing a styrene-based macromer having a polymerizable functional group at one terminal end thereof (hereinafter referred to merely as a "styrene-based macromer"). Examples of the styrene-based macromer include styrene homopolymers having a polymerizable functional group at one terminal end thereof, and copolymers of styrene with other monomers which have a polymerizable functional group at one terminal end thereof. The polymerizable functional group bonded to one terminal end of the styrene-based macromer is preferably an acryloyloxy group or a methacryloyloxy group. Examples of the other monomers copolymerizable with styrene include the below-mentioned monomers (c-2) and (c-3) and acrylonitrile. In the side chain or the styrene-based macromer, the constitutional unit derived from the styrene-based monomer has a largest content. Specifically, from the viewpoint of well incorporating a sufficient amount of the colorant into the water-insoluble graft polymer and enhancing an image density, the content of the constitutional unit derived from the styrene-based monomer in the side chain or the styrene-based macromer is preferably 60% by weight or larger, more preferably 70% by weight or larger and still more preferably 90% by weight or larger.

The number-average molecular weight of the styrene-based macromer is preferably in the range of from 1,000 to 10,000 and more preferably from 2,000 to 8,000 in view of reducing a viscosity thereof while increasing a copolymerization ratio thereof to enhance a storage stability of the resulting toner.

The styrene-based macromer is commercially available, for example, from Toagosei Co., Ltd., as product names of AS-6, AS-6S, AN-6, AN-6S, HS-6, HS-6S, etc.

(c-2) (Meth)Acrylic Acid Ester (Which Contains an Alkyl Group Having 1 to 22 Carbon Atoms and Preferably 1 to 18 Carbon Atoms, and May Also Have a Hydroxyl Group):

Specific examples of the (meth)acrylic acid ester include methyl(meth)acrylate, ethyl(meth)acrylate, (iso)propyl (meth)acrylate, 2-hydroxyethyl(meth)acrylate, (iso- or tertiary-)butyl(meth)acrylate, 2-ethylhexyl(meth)acrylate, (iso) octyl(meth)acrylate, (iso)decyl(meth)acrylate and (iso) stearyl(meth)acrylate. The side chain containing the constitutional unit derived from the (meth)acrylic acid ester having 1 to 22 carbon atoms which may also have a hydroxyl group, may be produced by copolymerizing an alkyl(meth) acrylate-based macromer having a polymerizable functional group at one terminal end thereof (hereinafter referred to merely as an "alkyl(meth)acrylate-based macromer"). As the alkyl(meth)acrylate-based macromer, there may be used, for example, methyl methacrylate-based macromers, butyl acrylate-based macromers, isobutyl methacrylate-based macromers and lauryl methacrylate-based macromers. Examples of the alkyl(meth)acrylate-based macromer include alkyl (meth)acrylate homopolymers having a polymerizable functional group at one terminal end thereof, and copolymers of the alkyl(meth)acrylate with other monomers which have a polymerizable functional group at one terminal end thereof. The polymerizable functional group bonded to one terminal end of the alkyl(meth)acrylate-based macromer is preferably an acryloyloxy group or a methacryloyloxy group. Examples of the other monomers copolymerizable with the alkyl(meth) acrylate include the above-mentioned monomer (c-I) and the below-mentioned monomer (c-3). In the side chain or the alkyl(meth)acrylate-based macromer, the constitutional unit derived from the monomer (c-2) has a largest content. Specifically, the content of the constitutional unit derived from the monomer (c-2) in the side chain or the alkyl(meth)acrylate-based macromer is preferably 60% by weight or larger, more preferably 70% by weight or larger and still more preferably 90% by weight or larger.

(c-3) Aromatic Ring-Containing (Meth)acrylate:

As the aromatic ring-containing (meth)acrylate, there are preferably used those represented by the above formula (1-1). Examples of the aromatic ring-containing (meth)acrylate include benzyl(meth)acrylate, phenoxyethyl(meth)acrylate, 2-hydroxy-3-phenoxypropyl acrylate and 2-methacryloyloxyethyl-2-hydroxypropyl phthalate. Among these aromatic ring-containing (meth)acrylates, preferred is benzyl(meth) acrylate. The side chain containing the constitutional unit derived from the aromatic ring-containing (meth)acrylate may be produced by copolymerizing an aromatic ring-containing (meth)acrylate-based macromer having a polymerizable functional group at one terminal end thereof (hereinafter referred to merely as an "aromatic ring-containing (meth) acrylate-based macromer"). Examples of the aromatic rung-containing (meth)acrylate-based macromer include aromatic ring-containing (meth)acrylate homopolymers having a polymerizable functional group at one terminal end thereof, and copolymers of the aromatic ring-containing (meth)acrylate with other monomers which have a polymerizable functional group at one terminal end thereof. The polymerizable functional group bonded to one terminal end of the aromatic ring-containing (meth)acrylate-based macromer is preferably an acryloyloxy group or a methacryloyloxy group. Examples of the other monomers copolymerizable with the aromatic ring-containing (meth)acrylate include the above-mentioned monomers (c-1) and (c-2). In the aromatic ring-containing (meth)acrylate-based macromer, the constitutional unit derived from the monomer (c-3) has a largest content. Since the water-insoluble graft polymer used in the present invention contains the constitutional unit derived from the aromatic ring-containing (meth)acrylate in the main chain, in order to attain the effects of the present invention, the content of the constitutional unit derived from the aromatic ring-containing (meth)acrylate in the side chain or the aromatic ring-containing (meth)acrylate-based macromer is preferably less than 50% by weight and more preferably 40% by weight or less, The side chain may also contain a constitutional unit derived from the other monomer copolymerizable with the above hydrophobic monomer. Examples of the other monomer include acrylonitrile, vinyl naphthalene, ethyl vinyl benzene, 4-vinyl biphenyl and 1,1-diphenyl ethylene.

These other monomers may be used alone or in combination of any two or more thereof.

The hydrophobic monomer used for forming the constitutional unit derived from the hydrophobic monomer (c) is preferably the styrene-based monomer (c-1) in view of enhancing an image density.

The above styrene-based macromer, alkyl(meth)acrylate-based macromer, and aromatic ring-containing (meth)acrylate-based macromer are hereinafter generally referred to merely as a "macromer".

The weight ratio of the main chain containing the constitutional unit derived from the salt-forming group-containing monomer (a) and the constitutional unit derived from the aromatic ring-containing monomer (b) to the side chain [main chain/side chain] in the water-insoluble graft polymer used in the present invention is preferably from 1/1 to 20/1, more preferably from 3/2 to 15/1 and still more preferably from 2/1 to 10/1 in view of enhancing an image density and the like (calculated assuming that the polymerizable functional group of the macromer is contained in the side chain; hereinafter calculated in the same way), The water-insoluble polymer used in the present invention may be produced by copolymerizing a monomer mixture containing the salt-forming group-containing monomer (a) and the aromatic ring-containing monomer (b) preferably together with the macromer, and preferably by copolymerizing the above monomer mixture with a monomer mixture containing the nonionic monomer (d) and/or the hydrophobic monomer (e) (hereinafter, these mixtures are generally referred to as a "monomer mixture").

The content of the salt-forming group-containing monomer (a) in the monomer mixture (calculated as a content of non-neutralized monomer; hereinafter calculated in the same way) or the content of the constitutional unit derived from the salt-forming group-containing monomer (a) which is contained in the main chain in the water-insoluble polymer is preferably from 3 to 30% by weight, more preferably from 3 to 20% by weight and still more preferably from 5 to 15% by weight in view of enhancing a dispersion stability of the resulting dispersion.

The content of the aromatic ring-containing monomer (b) in the monomer mixture or the content of the constitutional unit derived from the aromatic ring-containing monomer (b) which is contained in the main chain in the water-insoluble polymer is preferably from 10 to 80% by weight, more preferably from 15 to 80% by weight, still more preferably from 20 to 70% by weight, and further still more preferably from 20 to 65% by weight in view of a good dispersibility of the colorant-containing polymer particles, a high image density and a good tribocharge property of the toner.

The content of the macromer in the monomer mixture or the content of the constitutional unit derived from the hydrophobic monomer (c) which is contained in the side chain in the water-insoluble graft polymer is preferably from 5 to 50% by weight, more preferably from 5 to 40% by weight, still more preferably from 5 to 35% by weight and further still more preferably from 5 to 20% by weight in view of enhancing an image density.

The content of the nonionic monomer (d) in the monomer mixture, i.e., the content of the constitutional unit derived from the nonionic monomer (d) in the water-insoluble polymer is preferably from 0 to 60% by weight, more preferably from 10 to 50% by weight and still more preferably from 10 to 40% by weight in view of a high image density.

The content of the hydrophobic monomer (e) in the monomer mixture, i.e., the content of the constitutional unit derived from the hydrophobic monomer (e) in the water-insoluble polymer is preferably from 0 to 40% by weight and more preferably from 0 to 20% by weight in view of a high image density, a good dispersion stability.

The content ratio by weight of the salt-forming group-containing monomer (a) to the macromer in the monomer mixture [content of the salt-forming group-containing monomer/content of the macromer], or the content ratio by weight of the constitutional unit derived from the salt-forming group-containing monomer (a) contained in the main chain to the constitutional unit derived from the hydrophobic monomer (c) preferably contained in the side chain [content of the constitutional unit derived from the salt-forming group-containing monomer (a)/content of the constitutional unit derived from the hydrophobic monomer (c)] which are contained in the water-insoluble graft polymer, is preferably from 1/5 to 2/1 and more preferably from 1/4 to 2/1 in view of a high image density of the toner.

The content ratio by weight of the aromatic ring-containing monomer (b) to the nonionic monomer (d) in the monomer mixture [content of the aromatic ring-containing monomer (b)/content of the nonionic monomer (d)], or the content ratio by weight of the constitutional unit derived from the aromatic ring-containing monomer (b) to the constitutional unit derived from the nonionic monomer (d) which are contained in the water-insoluble polymer [content of the constitutional unit derived from the aromatic ring-containing monomer (b)/content of the constitutional unit derived from the nonionic monomer (d)] is preferably from 5/1 to 1/2 and more preferably from 4/1 to 1/2 in view of a high image density.

The term "water-insoluble" of the water-insoluble polymer as used in the present invention means that the water-insoluble polymer whose salt-forming group is neutralized 100% with sodium hydroxide or acetic acid according to the kind of salt-forming group, is dissolved at 25° C. in 100 g of water in an amount of 10 g or less, preferably 5 g or less and especially preferably 1 g or less.

In the present invention, the water-insoluble polymer in which the salt-forming group derived from the salt-forming group-containing monomer is neutralized with the below-mentioned neutralizing agent is used. The degree of neutralization of the salt-forming group is preferably from 10 to 200%, more preferably from 20 to 150% and still more preferably from 30 to 100%.

When the salt-forming group is an anionic group, the degree of neutralization is calculated according to the following formula:

[weight (g) of neutralizing agent/equivalent of neutralizing agent]/[acid value of polymer (KOH mg/g)×weight (g) of polymer/(56×1000)]×100.

When the salt-forming group is a cationic group, the degree of neutralization is calculated according to the following formula:

[weight (g) of neutralizing agent/equivalent of neutralizing agent]/[amine value of polymer (HCl mg/g)×weight (g) of polymer/(36.5×1000)]×100.

The acid value or amine value may be calculated from the respective constitutional units of the water-insoluble polymer, or may also be determined by the method of subjecting a solution prepared by dissolving the polymer in an appropriate solvent such as, for example, methyl ethyl ketone to titration.

The weight-average molecular weight of the water-insoluble polymer used in the present invention is preferably from 5,000 to 500,000, more preferably from 10,000 to 400,000 and still more preferably from 10,000 to 300,000 in view of a good dispersion stability of the colorant, a good water resistance of the resulting toner.

Meanwhile, the weight-average molecular weight of the water-insoluble polymer may be measured by gel permeation chromatography using dimethylformamide containing 60 mmol/L of phosphoric acid and 50 mmol/L of lithium bromide as a solvent and using polystyrene as a standard reference material.

The water-insoluble polymer used in the present invention may be produced by copolymerizing the monomer mixture by known polymerization methods such as bulk polymerization, solution polymerization, suspension polymerization and emulsion polymerization. Among these polymerization methods, preferred is the solution polymerization.

The solvent for the solution polymerization method is preferably an organic polar solvent. The organic polar solvent miscible with water may be used in the form of a mixture with water.

Examples of the organic polar solvents include aliphatic alcohols having from 1 to 3 carbon atoms such as methanol, ethanol and propanol; ketones such as acetone, methyl ethyl ketone and methyl isobutyl ketone; and esters such as ethyl acetate. Among these solvents, preferred are methanol, ethanol, acetone, methyl ethyl ketone and mixed solvents of at least one thereof with water.

The polymerization may be carried out in the presence of a radical polymerization initiator. Preferred radical polymerization initiators are azo compounds such as 2,2'-azobisisobutyronitrile, 2,2'-azobis(2,4-dimethylvaleronitrile), dimethyl-2,2'-azobisbutyrate, 2,2'-azobis(2-methylbutyronitrile), and 1,1'-azobis(1-cyclohexanecarbonitrile). Alternatively, organic peroxides such as tent-butyl peroxyoctoate, di-tert-butyl peroxide and dibenzoyl oxide may also be used.

The amount of the radical polymerization initiator to be used is preferably from 0.001 to 5 mol and preferably from 0.01 to 2 mol per 1 mol of the monomer mixture.

The polymerization may also be carried out in the presence of a polymerization chain transfer agent. Specific examples of the polymerization chain transfer agent include mercaptans such as octyl mercaptan, n-dodecyl mercaptan, tert-dodecyl mercaptan, n-tetradecyl mercaptan, mercaptoethanol, 3-mercapto-1,2-propanediol and mercaptosuccinic acid; thiuram disulfides; hydrocarbons; unsaturated cyclic hydrocarbon compounds; and unsaturated heterocyclic compounds. These polymerization chain transfer agents may be used alone or in combination of any two or more thereof.

The polymerization conditions of the monomer mixture vary depending upon the kinds of radical polymerization initiator, monomers, solvent, etc., to be used, and are therefore not particularly limited. The polymerization is generally conducted at a temperature of preferably from 30 to 100° C. and more preferably from 50 to 80° C., and for a time of preferably from 1 to 20 h. The polymerization is preferably conducted in an atmosphere of an inert gas such as nitrogen and argon.

After completion of the polymerization, the water-insoluble polymer thus produced is isolated from the reaction solution by a known method such as reprecipitation and removal of solvent by distillation. The thus obtained water-insoluble polymer may be purified by repeated reprecipitation, membrane separation, chromatography, extraction, etc., for removing unreacted monomers, etc., therefrom.

Dispersion Containing Colorant-Containing Polymer Particles

The dispersion containing the colorant-containing polymer particles is preferably produced through the following steps (1) and (2):

Step (1): dispersing a mixture containing the water-insoluble polymer, organic solvent, neutralizing agent, colorant, water, etc.; and Step (2): removing the organic solvent from the resulting dispersion.

In the step (1), first, the water-insoluble polymer is dissolved in an organic solvent, and then the colorant, neutralizing agent and water together with an optional surfactant, etc., are added to the solution of the water-insoluble polymer in the organic solvent under mixing to obtain a dispersion of an oil-in-water type. The content of the colorant in the mixture is preferably from 5 to 50% by weight. The content of the organic solvent in the mixture is preferably from 10 to 70% by weight. The content of the water-insoluble polymer in the mixture is preferably from 2 to 40% by weight, and the content of water in the mixture is preferably from 10 to 70% by weight. The degree of neutralization of the polymer is not particularly limited. In general, the degree of neutralization is preferably controlled such that the finally obtained dispersion exhibits a pH of 4.5 to 10. The pH of the dispersion may also be determined from the desirable degree of neutralization for the water-insoluble polymer. The water-insoluble polymer may be neutralized with the neutralizing agent in advance.

Examples of the preferred organic solvents include alcohol solvents, ketone solvents and ether solvents, i.e., the organic solvents are preferably those having a solubility in water of 50% by weight or lower and more preferably 10% by weight or larger as measured at 20° C. Examples of the alcohol solvents include n-butanol, tertiary butanol, isobutanol and diacetone alcohol. Examples of the ketone solvents include methyl ethyl ketone, diethyl ketone and methyl isobutyl ketone. Examples of the ether solvents include dibutyl ether and dioxane. Among these solvents, from the viewpoint of a good dispersibility of the colorant therein, preferred is methyl ethyl ketone.

As the neutralizing agent, acids or bases may be used according to the kind of salt-forming group in the water-insoluble polymer. Examples of the neutralizing agent include acids such as hydrochloric acid, acetic acid, propionic acid, phosphoric acid, sulfuric acid, lactic acid, succinic acid, glycolic acid, gluconic acid and glyceric acid, and bases such as lithium hydroxide, sodium hydroxide, potassium hydroxide, ammonia, methylamine, dimethylamine, trimethylamine, ethylamine, diethylamine, triethylamine and triethanolamine.

The method of dispersing the mixture in the step (1) is not particularly limited. The mixture may be finely dispersed only by substantial dispersion procedure until the volume median particle size ($D_{50}$) of the water-insoluble polymer particles reaches a desired value. Preferably, the mixture is first subjected to preliminary dispersion procedure, and then to the substantial dispersion procedure by applying a shear stress thereto so as to control the volume median particle size ($D_{50}$) of the water-insoluble polymer particles to a desired value.

Upon subjecting the mixture to the preliminary dispersion procedure, there may be used ordinary mixing or stirring devices such as anchor blades. Examples of the preferred mixing or stirring devices include high-speed mixers or stirrers such as "Ultra Disper" (tradename: available from Asada Tekko Co., Ltd., "Ebara Milder" (tradename: available from Ebara Corporation), "TK Homomixer", "TK Pipeline Mixer", "TK Homo Jetter", "TK Homomic Line Flow" and "Filmix" (tradenames: all available from Tokushu Kika Kogyo Co., Ltd.), "Clearmix" (tradename: available from M-Technic Co., Ltd.) and "K.D. Mill" (tradename: available from Kinetics Dispersion Inc.).

To apply the shear stress to the mixture in the substantial dispersion procedure, there may be used, for example, kneading machines such as roll mills, beads mills, kneaders and extruders, homo-valve-type high-pressure homogenizers such as typically "High-Pressure Homogenizer" (tradename: available from Izumi Food Machinery Co., Ltd.) and "Mini-Labo 8.3H Model" (tradename: available from Rannie Corp.), and chamber-type high-pressure homogenizers such as "Micro-Fluidizer" (tradename: available from Microfluidics Inc.), "Nanomizer" (tradename: available from Nanomizer Co., Ltd.), "Altimizer" (tradename: available from Sugino Machine Co., Ltd.), "Genus PY" (tradename: available from Hakusui Kagaku Co., Ltd.) and "DeBEE 2000" (tradename: Nippon BEE Co., Ltd.). Among these apparatuses, the high-pressure homogenizers are preferred in view of reducing a particle size of the colorant contained in the mixture.

In the step (2), the organic solvent is removed from the thus obtained dispersion to render the dispersion aqueous and thereby obtain a dispersion of the colorant-containing water-insoluble polymer particles. The removal of the organic solvent from the dispersion may be performed by an ordinary method such as distillation under reduced pressure. The organic solvent is substantially completely removed from the thus obtained dispersion of the water-insoluble polymer particles. The content of the residual organic solvent in the dispersion is 0.1% by weight or smaller and preferably 0.01% by weight or smaller.

In the above dispersion of the colorant-containing water-insoluble polymer particles, solid components made of the colorant-containing water-insoluble polymer are dispersed in water as a main solvent.

The configuration of the colorant-containing water-insoluble polymer particles is not particularly limited as long as the particles are formed of at least the colorant and the water-insoluble polymer. Examples of the configuration of the polymer particles include the particle configuration in which the colorant is enclosed in the respective water-insoluble polymer particles, the particle configuration in which the colorant is homogeneously dispersed in the respective water-insoluble polymer particles, and the particle configuration in which the colorant is exposed onto a surface of the respective water-insoluble polymer particles.

The volume median particle size ($D_{50}$) of the colorant-containing water-insoluble polymer particles in the dispersion of the colorant-containing polymer particles is preferably from 0.01 to 0.5 μm, more preferably from 0.03 to 0.3 μm and especially preferably from 0.05 to 0.2 μm from the viewpoint of a good dispersion stability thereof. Meanwhile, the volume median particle size ($D_{50}$) may be measured using a laser-scattering particle size measuring apparatus "LA-920" available from Horiba, Ltd. The "volume median particle size ($D_{50}$)" as used herein means a particle size at which a cumulative volume frequency calculated on the basis of a volume fraction of particles from a smaller particle size side thereof is 50%.

The content of water in the dispersion of the colorant-containing polymer particles is preferably from 30 to 90% by weight and more preferably from 40 to 80% by weight, The surface tension of the dispersion is preferably from 30 to 65 mN/m and more preferably from 35 to 60 mN/m as measured at 20° C. The viscosity of a 10 wt % solution of the dispersion is preferably from 2 to 6 mPa·s and more preferably from 2 to 5 mPa·s as measured at 20° C.

(Dispersion of Resin Particles Containing Substantially No Colorant)

The dispersion of the resin particles containing substantially no colorant is preferably produced by dispersing a resin: (hereinafter occasionally referred to as a "resin binder") in an aqueous medium.

Aqueous Medium

The aqueous medium used for emulsifying the resin binder contains water as a main component. From the viewpoint of a good environmental suitability, the content of water in the aqueous medium is preferably 80% by weight or more, more preferably 90% by weight or more, still more preferably 95% by weight or more, and most preferably 100% by weight.

Examples of components other than water which may be contained in the aqueous medium include alcohol-based organic solvents such as methanol, ethanol, isopropanol and butanol, and water-soluble organic solvents such as acetone and methyl ethyl ketone. Among these organic solvents, from the viewpoint of preventing inclusion of a solvent into the toner, preferred are alcohol-based organic solvents incapable of dissolving the resin therein. In the present invention, the resin binder is more preferably dispersed in water solely without using substantially no organic solvent to form fine particles thereof.

Resin Binder

The resin binder preferably contains a polyester from the viewpoints of a good fusing property and a good durability of the toner. The content of the polyester in the resin binder is preferably 60% by weight or larger, more preferably 70% by weight or larger, still more preferably 80% by weight or larger and further still more preferably substantially 100% by weight from the viewpoints of a good fusing property and a good durability of the resulting toner. The polyester to be used in the resin binder may be in the form of either a crystalline polyester or an amorphous polyester.

Examples of resins other than the polyester which may be contained in the resin binder include known resins conventionally used for toners such as, for example, styrene-acrylic copolymers, epoxy resins, polycarbonates and polyurethanes.

The monomers of the polyester are not particularly limited, and there may be used a known alcohol component and a known carboxylic acid component such as a carboxylic acid, a carboxylic acid anhydride and a carboxylic acid ester.

Examples of the carboxylic acid component include dicarboxylic acids such as terephthalic acid, fumaric acid, maleic acid, adipic acid and succinic acid; succinic acids substituted with an alkyl group having 1 to 20 carbon atoms or an alkenyl group having 2 to 20 carbon atoms such as dodecenylsuccinic acid and octenylsuccinic acid; tri- or higher-valent polycarboxylic acids such as trimellitic acid; and anhydrides and alkyl ($C_1$ to $C_3$) esters of these acids.

These carboxylic acid components may be used alone or in combination of any two or more thereof.

Specific examples of the alcohol component include alkylene ($C_2$ to $C_3$) oxide adducts (average molar number of addition: 1 to 16) of bisphenol A such as polyoxypropylene-2,2-bis(4-hydroxyphenyl)propane and polyoxyethylene-2,2-bis(4-hydroxyphenyl)propane, hydrogenated bisphenol A, ethylene glycol, propylene glycol, 1,4-butanediol, glycerol, trimethylol propane, and alkylene ($C_2$ to $C_4$) oxide adducts (average molar number of addition: 1 to 16) thereof. Among these compounds, preferred are alkylene ($C_2$ to $C_3$) oxide adducts (average molar number of addition: 1 to 16) of bisphenol A such as polyoxypropylene-2,2-bis(4-hydroxyphenyl)propane and polyoxyethylene-2,2-bis(4-hydroxyphenyl)propane. These alcohol components may also be used in combination of any two or more thereof.

The polyester may be produced, for example, by polycondensing the alcohol component and the carboxylic acid component in an inert gas atmosphere at a temperature of about 180 to about 250° C., if required, by using an esterification catalyst.

Examples of the esterification catalyst include tin compounds such as dibutyl tin oxide and tin dioctylate, and titanium compounds such as titanium diisopropylate bistriethanol aminate. The amount of the esterification catalyst to be used is preferably from 0.01 to 1 part by weight and more preferably from 0.1 to 0.6 part by weight on the basis of 100 parts by weight of a sum of the alcohol component and the carboxylic acid component.

From the viewpoint of a good storage stability of the resulting toner, the polyester preferably has a softening point of from 70 to 165° C. and a glass transition point of from 50 to 85° C. The acid value of the polyester is preferably from 6 to 35 mg KOH/g, more preferably from 10 to 35 mg KOH/g and still more preferably from 15 to 35 mg KOH/g from the viewpoint of facilitated production of the polyester. The softening point or the acid value of the polyester may be desirably adjusted by controlling the proportions of the alcohol and carboxylic acid charged, and the temperature and time used in the polycondensation reaction.

From the viewpoint of a good durability of the resulting toner, the number-average molecular weight of the polyester is preferably from 1,000 to 10,000 and more preferably from 2,000 to 8,000.

Meanwhile, in the present invention, as the polyester, there may be used not only unmodified polyesters but also modified polyesters obtained by modifying the polyesters to such an extent that the polyesters are substantially free from deterioration in inherent properties thereof. Examples of the modified polyesters include polyesters grafted or blocked with phenol, urethane, epoxy, etc., by the methods described, for example, in JP-A 11-133668, JP-A 10-239903 and JP-A 8-20636, and composite resins containing two or more kinds of resin units including a polyester unit.

Meanwhile, when the resin binder forming the resin particles is composed of a plurality of resins, the softening point, glass transition point, acid value and number-average molecular weight of the resin binder forming the resin particles mean the softening point, glass transition point, acid value and number-average molecular weight of a mixture of these resins, respectively. The respective values of the mixture are preferably the same as those of the polyester.

Further, from the viewpoints of a good fusing property and a good durability of the toner, the resin binder may contain two kinds of polyesters which are different in softening point from each other in which one polyester (1) preferably has a softening point of not lower than 70° C. and lower than 115° C., and the other polyester (ii) preferably has a softening point of not lower than 115° C. and not higher than 165° C. The weight ratio of the polyester (i) to the polyester (ii) (i/ii) in the resin binder is preferably from 10/90 to 90/10 and more preferably from 50/50 to 90/10.

In the present invention, from the viewpoint of a good dispersibility of the colorant, the solubility parameter (SP value) of the above resin binder is preferably close to that of the polymer used in the dispersion of the colorant-containing polymer particles. More specifically, the difference between the solubility parameters of the resin binder and the polymer preferably lies within the range of 5 or less and more preferably 4 or less.

The above SP value may be measured or calculated by several known methods. In the present invention, there is used the value calculated by the method described in Michael M. Collman, John F. Graf and Paul C. Painter (Pennsylvania State Univ.), "Specific Interactions and the Miscibility of Polymer Blends", (1991), Technomic Publishing Co., Inc. However, since no descriptions concerning a —COOH group and a —OH group are present in the literature, those values described in R. F. Fedors "Polymer Engineering and Science", 14(2), 147(1974) are used therefore.

Dispersion of Resin Particles Containing Substantially No Colorant

In the present invention, the dispersion of the resin particles containing the resin binder is preferably produced in an aqueous medium. However, the dispersion of the resin particles containing substantially no colorant (hereinafter occasionally referred to merely as a "resin dispersion") is preferably produced by emulsifying the resin binder from the viewpoints of reducing a particle size of the resin particles and obtaining a toner having a uniform particle size distribution.

The resin particles contained in the resin dispersion may contain, in addition to the resin binder, various optional additives such as a releasing agent, a charge controlling agent, a crosslinking agent, a reinforcing filler such as fibrous materials, an antioxidant and an age resistor, if required. In addition, although the resin particles contain substantially no colorant, the colorant may be included in the resin particles to such an extent that it gives no adverse influence on the aimed effects of the present invention.

Examples of the releasing agent include low-molecular weight polyolefins such as polyethylene, polypropylene and polybutene; silicones exhibiting a softening point upon heating; fatty acid amides such as oleamide; vegetable waxes such as carnauba wax, rice wax and candelilla wax; animal waxes such as beeswax; mineral and petroleum waxes such as montan wax, paraffin wax and Fischer-Tropsch wax; and the like. These releasing agents may be used alone or in combination of any two or more thereof.

The content of the releasing agent in the resin particles is usually from about 1 to about 20 parts by weight and preferably from 2 to 15 parts by weight on the basis of 100 parts by weight of the resin binder in view of attaining good effects due to addition thereof and preventing adverse influence on a tribocharge property of the toner.

Examples of the charge controlling agent include metal salts of benzoic acid, metal salts of salicylic acid, metal (such as chromium, iron and aluminum)-containing bisazo dyes and quaternary ammonium salts.

The, content of the charge controlling agent in the resin particles is preferably 10 parts by weight or less and more preferably from 0.01 to 5 parts by weight on the basis of 100 parts by weight of the resin binder.

Examples of the crosslinking agent and the reinforcing filler include those substances capable of chemically bonding to a carboxylic acid moiety or a hydroxyl group of the polyester, such as oxazoline group-containing compounds, epoxy group-containing compounds, aziridine group-containing compounds, isocyanate group-containing compounds and imide group-containing compounds. Also, divalent or higher-valent metal salts may be dispersed in the resin particles to subject the resin particles to ionomer-like metal crosslinking. The content of the crosslinking agent or reinforcing filler in the resin particles, if added, is preferably 10 parts by weight or less and more preferably from 0.1 to 5 parts by weight on the basis of 100 parts by weight of the resin binder.

In the present invention, when dispersing the resin binder in the aqueous medium, from the viewpoints of an enhanced dispersion stability of the resin binder, etc., a surfactant is allowed to be present in the dispersion in an amount of preferably 10 parts by weight or less, more preferably 5 parts by weight or less, still more preferably from 0.1 to 3 parts by weight and further still more preferably from 0.5 to 2 parts by weight on the basis of 100 parts by weight of the resin binder.

Examples of the surfactant include anionic surfactants such as sulfate-based surfactants, sulfonate-based surfactants and soap-based surfactants; cationic surfactants such as amine salt-type surfactants and quaternary ammonium salt-type surfactants; and nonionic surfactants such as polyethylene glycol-based surfactants, alkyl phenol ethyleneoxide adduct-based surfactants and polyhydric alcohol-based surfactants. Among these surfactants, preferred are ionic surfactants such as anionic surfactants and cationic surfactants. The nonionic surfactant is preferably used in combination with the anionic surfactant or the cationic surfactant. These respective surfactants may be used alone or in combination of any two or more thereof.

Specific examples of the anionic surfactants include dodecylbenzenesulfonic acid, sodium dodecylbenzenesulfonate, sodium dodecylsulfate, sodium alkylethersulfates and sodium alkylnaphthalenesulfonates. Among these anionic surfactants, preferred is sodium dodecylbenzenesulfonate.

Specific examples of the cationic surfactants include alkylbenzenedimethyl ammonium chlorides and alkyltrimethyl ammonium chlorides.

Examples of the nonionic surfactants include polyoxyethylene alkyl aryl ethers or polyoxyethylene alkyl ethers such as polyoxyethylene nonylphenyl ether, polyoxyethylene oleyl ether and polyoxyethylene lauryl ether; polyoxyethylene sorbitan esters such as polyoxyethylene sorbitan monolaurate; and polyoxyethylene fatty acid esters such as polyethylene glycol monolaurate.

The resin dispersion is preferably obtained by adding an aqueous alkali solution to the resin binder to disperse the resin binder together with optional additives in an aqueous medium.

The aqueous alkali solution used for dispersing the resin binder preferably has a concentration of from 1 to 20% by weight, more preferably from 1 to 10% by weight and still more preferably from 1.5 to 7.5% by weight. As the alkali of the aqueous alkali solution, there may be suitably used such an alkali which allows a salt of the alkali and the polyester to exhibit an enhanced surface activity. Specific examples of the alkali include hydroxides of a monovalent alkali metal such as potassium hydroxide and sodium hydroxide.

After dispersing the resin binder, etc., in the aqueous alkali solution, the resulting dispersion is preferably neutralized at a temperature not lower than a glass transition point of the resin binder. Thereafter, the aqueous medium is added to the dispersion at a temperature not lower than the glass transition point of the resin binder to emulsify the resin binder therein, thereby preparing the resin dispersion.

The velocity of addition of the aqueous medium to the dispersion is preferably from 0.1 to 50 g/min, more preferably from 0.5 to 40 g/min and still more preferably from 1 to 30 g/min per 100 g of the resin from the viewpoint of efficiently conducting the emulsifying step. The above velocity of addition of the aqueous medium may be generally maintained until an O/W type emulsion is substantially formed. Therefore, the velocity of addition of the aqueous medium after forming the O/W type emulsion is not particularly limited.

Examples of the aqueous medium used upon production of the resin emulsion include the same aqueous media as described above. Among these aqueous media, preferred are deionized water and distilled water.

The amount of the aqueous medium to be added is preferably from 100 to 2,000 parts by weight and more preferably from 150 to 1,500 parts by weight on the basis of 100 parts by weight of the resin binder from the viewpoint of obtaining homogeneous aggregated particles in the subsequent aggregating treatment. The amount of the aqueous medium to be added is controlled such that the solid content of the resulting resin dispersion preferably lies within the range of from 7 to 50% by weight, more preferably from 7 to 40% by weight and still more preferably from 10 to 30% by weight, from the viewpoints of a good stability and a good handling property of the resulting resin dispersion.

From the viewpoint of preparing the resin dispersion containing fine resin particles, the addition of the aqueous medium is preferably conducted at a temperature not lower than the glass transition point of the resin binder and not higher than the softening point thereof. When the addition of the aqueous medium is conducted in the above-specified temperature range, the resin binder can be smoothly emulsified in the aqueous medium, and any special apparatus is not required therefore. From the above viewpoints, the temperature used upon production of the resin dispersion is preferably a temperature not lower than the "glass transition point of the resin binder +(plus) 10° C." (this means a "temperature higher by 10° C. than the glass transition point of the resin binder"; hereinafter, the similar expression should be construed to have the similar meaning), but a temperature not higher than the "softening point of the resin binder −(minus) 5° C.".

The volume median particle size ($D_{50}$) of the resin particles contained in the thus obtained resin dispersion is preferably from 0.02 to 2 μm, more preferably from 0.05 to 1 μm and still more preferably from 0.05 to 0.6 μm for the purpose of homogeneous aggregation thereof in the subsequent aggregating treatment.

As an alternative method for obtaining the resin dispersion in the aqueous medium, there may be used, for example, the method of emulsifying and dispersing polycondensable monomers as raw materials of the aimed resin particles in the aqueous medium, for example, by applying a mechanical shearing force or an ultrasonic wave thereto. In this method, if required, additives such as a polycondensation catalyst and a surfactant may also be added to the aqueous medium. The polycondensation reaction of the monomers is allowed to proceed, for example, by heating the thus obtained solution. For example, when using a polyester as the resin binder, there may be used the polycondensable monomers and the polycondensation catalysts for polyesters as described above, and as the surfactant, there may also be used those described above.

In addition, when the polycondensable monomers are emulsified in the aqueous medium in the presence of a surfactant capable of forming a micelle in the aqueous medium, the monomers are present in a micro hydrophobic site in the micelle and subjected to dehydration reaction therein to produce water. By discharging the thus produced water into the aqueous medium outside of the micelle, the polymerization of the monomers can be allowed to proceed. Thus, it is possible to produce the aimed dispersion in which the resin particles obtained by the polycondensation are emulsified and dispersed in the aqueous medium, even under an energy saving condition.

(Mixing of Dispersion of Colorant-Containing Polymer Particles with Dispersion of Resin Particles Containing Substantially No Colorant)

In the present invention, the above dispersion of the colorant-containing polymer particles is mixed with the dispersion of the resin particles containing substantially no colorant and further with a releasing agent, if required.

The mixing ratio between the dispersion of the colorant-containing polymer particles and the dispersion of the resin particles containing substantially no colorant is preferably controlled from the viewpoint of a high image density such that the content of the colorant in the colorant-containing polymer particles is preferably from 3 to 30 parts by weight and more preferably from 3 to 20 parts by weight on the basis of 100 parts by weight of the resin binder.

(Aggregation of Colorant-Containing Polymer Particles and Resin Particles Containing Substantially No Colorant)

In the present invention, the above dispersion of the colorant-containing polymer particles is mixed with the dispersion of the resin particles containing substantially no colorant to aggregate the colorant-containing polymer particles and the resin particles together. Upon the aggregation, in order to effectively carry out the aggregation, an aggregating agent is added. Examples of the aggregating agent used in the present invention include organic aggregating agents such as a cationic surfactant in the form of a quaternary salt and polyethyleneimine, and inorganic aggregating agents such as an inorganic metal salt, an inorganic ammonium salt and a divalent or higher-valent metal complex. The inorganic metal salts include, for example, metal salts such as sodium sulfate, sodium chloride, calcium chloride; calcium nitrate, magnesium chloride, aluminum chloride and aluminum sulfate; and inorganic metal salt polymers such as poly(aluminum chloride). Specific examples of the inorganic ammonium salts include ammonium sulfate and ammonium chloride.

Among these aggregating agents, from the viewpoint of controlling a particle size of the toner with a high accuracy and achieving a sharp particle size distribution thereof, a monovalent salt is preferably used. The "monovalent salt" as used herein means that a valence of a metal ion or a cation constituting the salt is 1. Examples of the monovalent salt as the aggregating agent include organic aggregating agents such as cationic surfactants in the form of a quaternary salt, and inorganic aggregating agents such as inorganic metal salts and ammonium salts. In the present invention, among these aggregating agents, water-soluble nitrogen-containing compounds having a molecular weight of 350 or less are preferably used.

As the water-soluble nitrogen-containing compounds having a molecular weight of 350 or less, from the viewpoint of a good tribocharge property of the toner under high-temperature and high-humidity conditions, there may be used, for example, ammonium salts such as ammonium halides, ammonium sulfate, ammonium acetate, ammonium benzoate and ammonium salicylate; and quaternary ammonium salts such as tetraalkyl ammonium halides. From the viewpoint of a good productivity, among these compounds, preferred are ammonium sulfate (pH value of 10 wt % aqueous solution at 25° C. (hereinafter referred to merely as a "pH"): 5.4), ammonium chloride (pH: 4.6), tetraethyl ammonium bromide (pH: 5.6) and tetrabutyl ammonium bromide (pH: 5.8).

The amount of the aggregating agent used is preferably 50 parts by weight or less, more preferably 40 parts by weight or less and still more preferably 30 parts by weight or less on the basis of 100 parts by weight of the resin binder from the viewpoint of a good tribocharge property of the toner, in particular, the tribocharge property under high-temperature and high-humidity conditions, and is preferably 1 part by weight or more, more preferably 3 parts by weight or more, and still more preferably 5 parts by weight or more on the basis of 100 parts by weight of the resin binder from the viewpoint of a good aggregating property. From the above viewpoints, the amount of the monovalent salt used as the aggregating agent is preferably from 1 to 50 parts by weight, more preferably from 3 to 40 parts by weight and still more preferably from 5 to 30 parts by weight on the basis of 100 parts by weight of the resin binder.

After suitably controlling the pH value of the reaction system, the aggregating agent is added, at a temperature not higher than the "glass transition temperature of the resin binder +(plus) 20° C.", preferably not higher than the "glass transition temperature of the resin binder +(plus) 10° C." and more preferably lower than the "glass transition temperature of the resin binder +(plus) 5° C.". When adding the aggregating agent in the above-specified temperature range, it is possible to obtain aggregated particles having a narrow particle size distribution and a uniform particle size. In addition, the addition of the aggregating agent is preferably carried out at a temperature preferably not lower than the "softening point of the resin binder −(minus) 100° C." and more preferably not lower than the "softening point of the resin binder −(minus) 90° C.". From the viewpoint of achieving both a good dispersion stability of the mixed dispersion and a good aggregating property of the resin particles, the pH value of the reaction system upon addition of the aggregating agent is preferably from 2 to 10, more preferably from 2 to 8 and still more preferably from 3 to 7.

The aggregating agent may be added in the form of a solution thereof in an aqueous medium. In addition, the aggregating agent may be added to the dispersion collectively or in divided parts at one time, or may be added intermittently or continuously. Further, upon and after adding the aggregating agent, the obtained dispersion is preferably fully stirred.

Thus, the resin particles contained in the resin dispersion containing substantially no colorant and the colorant-containing polymer particles are aggregated together to prepare aggregated particles.

From the viewpoint of reduction in particle size, the volume median particle size ($D_{50}$) of the aggregated particles is preferably from 1 to 10 μm, more preferably from 2 to 9 μm and still more preferably from 2 to 5 μm, and the coefficient of variation of particle size distribution (CV value) of the aggregated particles is preferably 30 or less, more preferably 28 or less and still more preferably 25 or less.

Meanwhile, the coefficient of variation of particle size distribution (CV value) means the value represented by the following formula.

$$\text{CV Value}=[\text{Standard Deviation of Particle Size Distribution } (\mu m)/\text{Volume median Particle Size } (\mu m)]\times 100.$$

In the present invention, from the viewpoints of preventing bleed-out of the releasing agent or maintaining tribocharge of the respective colors in a color toner at the same level, etc., when aggregating the resin particles containing substantially no colorant (hereinafter occasionally referred to merely as "resin binder particles") and the colorant-containing polymer particles (both the particles are hereinafter occasionally referred to totally as "resin particles of the present invention"), other resin fine particles may be added thereto collectively or in divided parts at one time or may be added intermittently in plural divided parts. On the contrary, the resin particles of the present invention may be added to aggregated particles obtained by aggregating the other resin fine particles and the colorant-containing polymer particles of the present invention at one time or intermittently in plural divided parts to aggregate these particles.

The other resin fine particles which may be added to the resin particles of the present invention are not particularly limited, and may be produced, for example, by the same method as used for producing the resin particles contained in the resin dispersion of the present invention.

In the present invention, the other resin fine particles may be the same as or different from the resin binder particles among the resin particles of the present invention. However, from the viewpoints of a good low-temperature fusing property and a good storage stability of the resulting toner, the other resin fine particles which are different from the resin binder particles among the resin particles of the present invention are preferably added at one time or intermittently in plural divided parts.

In the above step, the above other resin fine particles may be mixed with the aggregated particles obtained by adding the aggregating agent to the mixed dispersion composed of the resin dispersion and the dispersion of the colorant-containing polymer particles as described above.

In the present invention, the time of addition of the other resin fine particles is not particularly limited, and preferably is within a period of from completion of addition of the aggregating agent to initiation of the subsequent coalescing step from the viewpoint of a high productivity.

In the present invention, the mixed dispersion composed of the resin dispersion and the dispersion of the colorant-containing polymer particles may also be mixed with the aggregated particles obtained by adding the aggregating agent to the above other resin fine particles.

The mixing ratio of the resin particles of the present invention to the other resin fine particles (resin particles of the present invention/other resin fine particles) is preferably from 0.1 to 2.0, more preferably from 0.2 to 1.5 and still more preferably from 0.3 to 1.0 in terms of a weight ratio therebetween from the viewpoint of achieving both of a good low-temperature fusing property and a good storage stability of the resulting toner.

In the present invention, after aggregating the resin particles containing substantially no colorant and the colorant-containing polymer particles, a surfactant is preferably added to the dispersion containing the aggregated particles. More preferably, at least one compound selected from the group consisting of alkylethersulfates, alkylsulfates and straight-chain alkylbenzenesulfonates is added to the dispersion.

The above surfactant is added in an amount of preferably from 0.1 to 15 parts by weight, more preferably from 0.1 to 10 parts by weight and still more preferably from 0.1 to 8 parts by weight on the basis of 100 parts by weight of the resins forming the aggregated particles from the viewpoints of a good aggregation stopping property and a suitable residual amount thereof in the toner.

The thus obtained aggregated particles are subjected to the step of coalescing the aggregated particles (coalescing step).

In the present invention, the thus obtained aggregated particles, i.e., those particles composed of the resin particles and the colorant-containing polymer particles, and further the releasing agent particles, if required, are heated to form coalesced particles thereof. The temperature of the reaction system in the coalescing step is desirably the same as or higher than the temperature used in the aggregating step. The temperature used in the coalescing step is preferably not lower than the glass transition point of the resin binder and not higher than the "softening point of the resin binder +(plus) 20° C."; more preferably not lower than the "grass transition point of the resin binder +(plus) 5° C." and not higher than the "softening point of the resin binder +(plus) 15° C."; and still more preferably not lower than the "grass transition point of the resin binder +(plus) 10° C." and not higher than the "softening point of the resin binder +(plus) 10° C." from the viewpoints of controlling a particle size, a particle size distribution and a shape of the toner as desired, and attaining a good fusibility of the particles. In addition, the stirring rate used in the coalescing step is preferably a rate at which the aggregated particles are not precipitated.

In the present invention, the coalescing step may also be carried out simultaneously with the aggregating step, for example, by continuously raising the temperature, or by heating the reaction system up to such a temperature capable of carrying out both of the aggregating and coalescing steps and then continuously stirring the reaction system at that temperature.

The volume median particle size ($D_{50}$) of the coalesced particles is preferably from 1 to 10 μm, more preferably from 2 to 8 μm and still more preferably from 3 to 8 μm from the viewpoint of a high image quality, The thus obtained coalesced particles may be subjected to a liquid-solid separation step such as filtration, a washing step, a drying step, etc., thereby obtaining toner particles. In the washing step, the coalesced particles are preferably washed to completely remove metal ions on the surface of the respective toner particles as well as the nonionic surfactant added, for the purpose of ensuring a sufficient tribocharge property and a good reliability of the resulting toner. In addition, the coalesced particles are preferably washed with an aqueous solution at a temperature not higher than a cloud point of the nonionic surfactant. Meanwhile, the washing procedure is preferably repeated a plurality of times.

In addition, in the drying step, any optional methods such as vibration-type fluidization drying method, spray-drying method, freeze-drying method and flash jet method may be employed. The water content in the toner particles obtained after drying is preferably adjusted to 1.5% by weight or less from the viewpoint of a good tribocharge property of the resulting toner.

[Toner for Electrophotography]

The toner for electrophotography according to the present invention is obtained by the above production process.

The toner for electrophotography according to the present invention preferably has a softening point of from 105 to 200° C., more preferably from 105 to 180° C. and still more preferably from 105 to 160° C. from the viewpoint of broadening a fusing temperature range of the resulting toner. In addition, the toner preferably has a glass transition point of from 30 to 80° C. and more preferably from 40 to 70° C. from the viewpoints of a good low-temperature fusing property and a good storage stability of the resulting toner. Meanwhile, the softening point and the glass transition point of the toner may be measured according to the same methods as used for measuring those of the resins.

The volume median particle size ($D_{50}$) of the toner particles and the toner is preferably 1 μm or more, and more preferably 2 μm or more, and is preferably 9 μm or less, more preferably 8 μm or less, still more preferably 7 μm or less and especially preferably 6 μm or less from the viewpoint of a high image quality.

In addition, the circularity of the toner (ratio of circumferential length of a circle having an area equal to a projected area of the toner/circumferential length of a projected image of the toner) is preferably from 0.93 to 1.00, more preferably from 0.94 to 0.99 and still more preferably from 0.95 to 0.99 from the viewpoint of enhancing a transfer property of the toner and broadening a fusing temperature range of the toner.

Also, the CV values of the above aggregated particles, coalesced particles and toner particles all are preferably 45 or less, more preferably 35 or less and still more preferably 30 or less.

The particle size and the particle size distribution of the toner particles may be measured by the below-mentioned methods.

The thus obtained toner particles can be directly used as the toner for electrophotography according to the present invention. Alternatively, an auxiliary agent such as a fluidizing agent may be added as an external additive to the resulting toner particles to treat the surface of the respective toner particles therewith, thereby forming the toner for electrophotography according to the present invention. As the external additive, there may be used known fine particles. Examples of the fine particles include inorganic fine particles such as fine silica particles whose surface is subjected to a hydrophobic treatment, fine titanium oxide particles and carbon blacks; and fine polymer particles such as fine particles made of polymethyl methacrylate, silicone resins, etc. The number-average particle size of the external additive is preferably from 4 to 500 nm, more preferably from 4 to 200 nm and still more preferably from 8 to 30 nm. The number-average particle size of the external additive may be determined using a scanning electron microscope or a transmission electron microscope.

The amount of the external additive compounded in the toner is preferably from 1 to 5 parts by weight and more preferably from 1.5 to 3.5 parts by weight on the basis of 100 parts by weight of the toner before being treated with the external additive.

The toner for electrophotography obtained according to the present invention may be used in the form of a one-component system developer or a two-component system developer formed by mixing the toner with a carrier.

EXAMPLES

In the following Examples, various properties were measured and evaluated by the following methods.

[Acid Value of Resins]

The acid value of a resin was measured by the same method as prescribed in JIS K0070 except that the solvent used in the measurement was replaced with a mixed solvent containing acetone and toluene at a volume ratio of 1:1.

[Softening Point and Glass Transition Point of Resins and Toner]

(1) Softening Point

Using a flow tester "CFT-500D" available from Shimadzu Corporation, 1 g of a sample was extruded through a nozzle having a die pore diameter of 1 mm and a length of 1 mm while heating the sample at a temperature rise rate of 6° C./rain and applying a load of 1.96 MPa thereto by a plunger. The softening point was determined as the temperature at which a half amount of the sample was flowed out when plotting a downward movement of the plunger of the flow tester relative to the temperature, (2) Glass Transition Point Using a differential scanning calorimeter ("Pyris 6 DSC" available from Perkin Elmer, Inc.), a sample was heated to 200° C. at a temperature rise rate of 10° C./min and then cooled from 200° C. to 0° C. at a temperature drop rate of 10° C./min, and thereafter heated again at temperature rise rate of 10° C./min to prepare an endothermic curve thereof. The glass transition point of the sample was read out from the endothermic curve and determined as the temperature at which an elongation of a base line below the endothermic highest peak temperature intersects a tangential line having a maximum inclination in a region from a leading edge to an apex of the peak in the curve.

[Solid Content]

Using an infrared moisture meter ("FD-230" available from Kett Electric Laboratory), 5 g of the dispersion was dried at 150° C. under a measuring mode 96 (monitoring time: 2.5 min; fluctuating width: 0.05%), and the water content (%) of the dispersion was measured. The solid content of the dispersion was calculated according to the following formula.

$$\text{Solid Content (\%)}=100-M$$

wherein M is a water content (%) of the dispersion represented by the following formula:

$$M=[(W-W_0)/W]\times 100$$

wherein W is a weight of the sample before measurement (initial weight of the sample); and $W_0$ is a weight of the sample after measurement (absolute dry weight of the sample).

[Particle Sizes of Resin Particles, Colorant-Containing Polymer Particles, Dispersed Releasing Agent Particles and Aggregated Particles]

(1) Measuring Apparatus: Laser Scattering particle size analyzer ("LA-920" commercially available from Horiba, Ltd.)

(2) Measuring Conditions: Using a cell for the measurement which was filled with distilled water, a volume median particle size ($D_{50}$) of the particles was measured at a temperature at which an absorbance thereof was fallen within an adequate range. Meanwhile, the particle size distribution was indicated by the CV value calculated according to the following formula:

$$\text{CV Value}=(\text{Standard Deviation of Particle Size Distribution/Volume median Particle Size } (D_{50}))\times 100.$$

[Particle Size of Toner]

Measuring Apparatus: Coulter Multisizer II (commercially available from Beckman Coulter Inc.)

Aperture Diameter: 50 μm

Analyzing Software: Coulter Multisizer AccuComp Ver. 1.19 (commercially available from Beckman. Coulter Inc.)

Electrolyte Solution: "Isotone II" (commercially available from Beckman Coulter Inc.)

Dispersing Solution: The dispersing solution was prepared by dissolving "EMALGEN 109P" (commercially available from Kao Corporation; polyoxyethylene lauryl ether; HLB: 13.6) in the above electrolyte solution such that the concentration of "EMALGEN 109P" in the obtained solution was 5% by weight.

Dispersing Conditions: Ten milligrams of a sample to be measured was added to 5 mL of the dispersing solution, and dispersed using an ultrasonic disperser for 1 min. Thereafter, 25 mL of the electrolyte solution was added to the dispersion, and the obtained mixture was further dispersed using the ultrasonic disperser for 1 min to prepare a sample dispersion.

Measuring Conditions: The thus prepared sample dispersion was added to 100 mL of the electrolyte solution, and after controlling a concentration of the resulting dispersion such that the determination of particle sizes of 30000 particles were completed within 20 s, the particle sizes of 30000 particles were measured under such a concentration condition, and a volume median particle size ($D_{50}$) thereof was determined from the particle size distribution.

The particle size distribution was indicated by the CV value calculated according to the following formula:

$$\text{CV Value}=(\text{Standard Deviation of Particle Size Distribution/Volume median Particle Size } (D_{50}))\times 100.$$

[Measurement of Molecular Weight Distribution of Water-Insoluble Polymer, Macromer and Resin Binder]

Tetrahydrofuran as an eluent was allowed to flow through a column at a flow rate of 1 mL/min, and the column was stabilized in a thermostat at 40° C. One hundred microliters of the sample solution was injected to the column to determine a molecular weight distribution of the sample. The molecular weight of the sample was calculated on the basis of a calibration curve previously prepared. The calibration curve of the molecular weight was prepared by using several kinds of monodisperse polystyrenes (those polystyrenes having molecular weights of $2.63\times10^3$, $2.06\times10^4$ and $1.02\times10^5$ available from Tosoh Corporation; and those polystyrenes having molecular weights of $2.10\times10^3$, $7.00\times10^3$ and $5.04\times10^4$ available from GL Science Co., Ltd.) as standard reference samples.

Analyzer: CO-8010 (commercially available from Tosoh Corp.)

Column: GMHLX+G3000HXL (commercially available from Tosoh Corp.)

Production Example 1

Production of Polyester A

The monomers of the polyester except for trimellitic anhydride and the esterification catalyst as shown in Table 1 were charged into a 5 L four-necked flask equipped with a thermometer, a stainless steel stirrer, a falling type condenser and a nitrogen inlet tube. The contents of the flask were reacted in a mantle heater in a nitrogen atmosphere at 230° C. under normal pressure (101.3 kPa) for 7 h, and further reacted under a pressure of 8.0 kPa for 1 h. Thereafter, the resulting reaction mixture was cooled to 210° C., and after adding trimellitic anhydride as shown in Table 1 thereto, the obtained mixture was reacted under normal pressures for 1 h and further reacted under a pressure of 8.0 kPa until a softening point of the reaction product reached a desired temperature, thereby obtaining a polyester A.

Production Example 2

Production of Polyester B

The monomers of the polyester except for fumaric acid and the esterification catalyst as shown in Table 1 were charged into a 5 L four-necked flask equipped with a thermometer, a stainless steel stirrer, a falling type condenser and a nitrogen inlet tube. The contents of the flask were reacted in a mantle heater in a nitrogen atmosphere at 230° C. under normal pressure (101.3 kPa) for 5 h, and further reacted under a pressure of 8.0 kPa for 1 h. Thereafter, the resulting reaction mixture was cooled to 185° C., and after adding fumaric acid and hydroquinone as shown in Table 1 thereto, the obtained mixture was heated to 210° C. over 4 h, and reacted at 210° C. for 1 h and further reacted under a pressure of 13.3 kPa until a softening point of the reaction product reached a desired temperature, thereby obtaining a polyester B.

TABLE 1

| | Polyester A | Polyester B |
|---|---|---|
| Bisphenol A (PO 2.0)*1 | 1695.4 g | 3559.2 g |
| Bisphenol A (EO 2.0)*2 | 1574.3 g | |
| Terephthalic acid | 1109.7 g | 703.4 g |
| Dodecenyl succinic anhydride | 155.8 g | |
| Fumaric acid | | 737.3 g |
| Trimellitic anhydride | 465.0 g | |
| Hydroquinone | | 2.5 g |
| Tin 2-ethylhexanoate | 25.0 g | 25.0 g |
| Softening point (° C.) | 124 | 109.6 |
| Glass transition point (° C.) | 69 | 66 |
| Acid value (mg KOH/g) | 19.7 | 21.1 |

Note
*1 2.0 mol propyleneoxide adduct of bisphenol A
*2 2.0 mol ethyleneoxide adduct of bisphenol A

Production Example 3

Production of Dispersion A of Resin Particles

A 10 L stainless steel pot was charged with 980 g of the polyester A, 1,820 g of the polyester B, 28 g of a nonionic surfactant ("EMALGEN 430" available from Kao Corp.), 186.7 g of an anionic surfactant ("NEOPELEX G-15" available from Kao Corp.; 15 wt % aqueous solution of sodium dodecylbenzenesulfonate) and 1,287 g of a potassium hydroxide aqueous solution (as a neutralizing agent; concentration: 5% by weight), and the contents of the pot were melted at 98° C. for 2 h while stirring with a paddle-shaped stirrer at a rate of 200 rpm, thereby obtaining a resin binder mixture. Successively, while stirring with a paddle-shaped stirrer at a rate of 200 rpm, 5,311 g in total of deionized water were added dropwise into the pot at a rate of 28 g/min to prepare a resin dispersion. Finally, the obtained resin dispersion was cooled to room temperature and passed through a wire mesh having a 200 mesh screen (aperture: 105 μm) to obtain an dispersion having a resin content of 29% by weight. The primary particles of the resin particles in the resulting dispersion had a volume median particle size ($D_{50}$) of 0.132 μm and a coefficient of variation of particle size distribution (CV value) of 22.1. No residual components remained on the wire mesh. The thus obtained dispersion was mixed with ion-exchanged water to control a resin content therein to 23% by weight, thereby obtaining a dispersion A of resin particles.

Production Example 4

Production of Dispersion 1 of Colorant-Containing Polymer Particles

Twenty parts by weight of methyl ethyl ketone and 0.03 part by weight of a polymerization chain transfer agent (2-mercaptoethanol) together with 10% by weight of 200 parts by weight of a monomer mixture shown in Table 2 were charged into a reaction vessel and mixed with each other, and then an inside of the reaction vessel was fully purged with a nitrogen gas to thereby obtain a mixed solution.

Separately, remaining 90% by weight of the monomer mixture shown in Table 2 were charged into a dropping funnel, and further 0.27 part by weight of the polymerization chain transfer agent (2-mercaptoethanol), 60 parts by weight of methyl ethyl ketone and 1.2 parts by weight of 2,2'-azobis (2,4-dimethylvaleronitrile) were added thereto and mixed with each other, and an inside of the dropping funnel was fully purged with a nitrogen gas to thereby obtain a mixed solution.

The mixed solution in the reaction vessel was heated to 65° C. under stirring in a nitrogen atmosphere, and then the mixed solution in the dropping funnel was gradually added dropwise thereinto over 3 h. After the aging of 2 h at 65° C. from completion of the dropping, a solution prepared by dissolving 0.3 part by weight of 2,2'-azobis(2,4-dimethylvaleronitrile) in 5 parts by weight of methyl ethyl ketone was added to the above obtained solution, and the resulting reaction solution was further aged at 65° C. for 2 h and then at 70° C. for 2 h to obtain a polymer solution. The thus obtained polymer was weighed in an amount of 0.2 g in a sampling bottle, and then deionized water was added thereto, thereby confirming that the polymer was water-insoluble.

The weight-average molecular weight of the thus obtained polymer was measured by gel permeation chromatography using a dimethylformamide solution containing 60 mmol/L of phosphoric acid and 50 mmol/L of lithium bromide as a solvent and using polystyrene as a standard substance. The results are shown in Table 2.

Meanwhile, the numerals indicated in Table 2 represent weight parts of the compounds used, and details of the respective compounds are shown below.

Polypropylene glycol monomethacrylate: average molar number of addition of propyleneoxide: 9: "BLENMER PP-500" (tradename) available from NOF Corporation.

Styrene Macromer: "AS-6S" (tradename) available from Toagosei Co., Ltd.; number-average molecular weight: 6000; polymerizable functional group: methacryloyloxy group Twenty five parts by weight of the polymer produced by drying the polymer solution obtained above under reduced pressure were dissolved in 70 parts by weight of methyl ethyl ketone. Further, 4.1 parts by weight of a neutralizing agent (a 5N sodium hydroxide aqueous solution) and 230 parts by weight of ion-exchanged water were added to the resulting solution to neutralize a salt-forming group of the polymer (degree of neutralization: 75%), and then 75 parts by weight of a copper phthalocyanine pigment (C.I. Pigment Blue 15:3 "TGR-SD" (tradename) available from DIC Corp.) were added into the reaction solution and mixed with each other at 20° C. for 1 h using disper blades. The thus obtained mixture was dispersed under a pressure of 200 MPa by passing through a dispersing apparatus "MICROFLUIDIZER" (tradename) available from Microfluidics Corp., 10 times.

The resulting dispersed mixture was mixed with 250 parts by weight of ion-exchanged water and then stirred. Thereafter, methyl ethyl ketone was removed from the resulting mixture under reduced pressure at 60° C., followed by removing a part of the water therefrom. The obtained mixture was filtered through a 5 μm-mesh filter (acetyl cellulose membrane; outer diameter: 2.5 cm; available from FUJIFILM Corporation) fitted to a 25 mL syringe without a needle available from Terumo Co., Ltd., to remove coarse particles therefrom, thereby obtaining a dispersion 1 of colorant-containing polymer particles which had a volume median particle size ($D_{50}$) of 75 nm and a solid content of 20% by weight.

Production Example 5

Production of Dispersion 2 of Colorant-Containing Polymer Particles

The same procedure as in Production Example 4 was repeated except for using the monomer composition as shown in Table 2, thereby obtaining a dispersion 2 of colorant-containing polymer particles which had a volume median particle size ($D_{50}$) of 68 nm and a solid content of 20% by weight.

The thus obtained polymer was weighed in an amount of 0.2 g in a sampling bottle, and then deionized water was added thereto, thereby confirming that the polymer was water-insoluble (the amount of the polymer dissolved was 0 g).

TABLE 2

| Polymer constituting colorant-containing polymer particles Kinds of monomers | | Production Example 4 | Production Example 5 |
|---|---|---|---|
| (a) Salt-forming group-containing monomer | Methacrylic acid | 10 | 14 |
| (b) Aromatic ring-containing monomer | Benzyl methacrylate | 50 | 61 |
| (c) Hydrophobic monomer | Styrene macromer | 15 | — |
| (d) Nonionic (meth)acrylate-based monomer | Polypropylene glycol monomethacrylate | 25 | 25 |
| Weight-average molecular weight | | 104,000 | 84,000 |

Comparative Production Example 1

Production of Colorant Water Dispersion A

A 2 L beaker was charged with 263 g of a copper phthalocyanine pigment (C.I. Pigment Blue 15:3 "TGR-SD" (tradename) available from DIC Corp.), 233 g of an anionic surfactant "NEOPELEX G-15" (sodium dodecylbenzenesulfonate; solid content: 15% by weight) available from Kao Corp., and 589 g of deionized water, and the contents of the flask were mixed with each other using a "HOMOMIXER" (available from Tokushu Kika Kogyo Co., Ltd.) at 5000 rpm for 5 min. The resulting mixed solution was dispersed under a pressure of 150 MPa by passing through a dispersing apparatus "MICROFLUIDIZER M-140K" available from Microfluidics Corp., 10 times, thereby obtaining a colorant water dispersion A. As a result, it was confirmed that the colorant particles dispersed in the thus obtained colorant water dispersion A had a volume median particle size ($D_{50}$) of 130 nm and a CV value of 25, and the colorant water dispersion A had a solid content of 27.5% by weight, and that any colorant particles having a volume-based particle size of 510 nm or larger were not recognized.

Comparative Production Example 2

Production of Master Batch 1

A Henschel mixer was charged with 1400 g of fine powder of the polyester B, 600 g of a dried powdery pigment of copper phthalocyanine and 600 g of water, and the contents of the mixer were mixed with each other for 5 min to obtain a wet mixture. The resulting mixture was charged into a kneader-type mixer and gradually heated. The resin was melted at a temperature of about 90 to about 110° C., and the mixture was kneaded under the condition that water was still present therein, and further continuously kneaded at a temperature of 90 to 110° C. for 20 min while evaporating water therefrom.

The resulting kneaded material was further continuously kneaded at 120° C. to evaporate residual water therefrom, followed by dehydrating and drying, and further continuously kneaded at a temperature of 120 to 130° C. for 10 min. After cooling, the obtained kneaded material was further kneaded with a heated three-roll mill, cooled and coarsely crushed, thereby obtaining a high-concentration colored composition in the form of coarse particles containing 30% of a blue pigment (master batch 1). The resulting composition was placed on a slide glass, and heated and melted. As a result of observing the melted composition by using a microscope, it was confirmed that the pigment particles were entirely finely dispersed in the composition, and no coarse particles were observed therein.

Comparative Production Example 3

Production of Colorant-Containing Resin Dispersion B

A 5 L stainless steel pot was charged with 980 g of the polyester A, 1,493 g of the polyester B, 467.6 g of the master batch 1, 28 g of a nonionic surfactant ("EMALGEN 430" available from Kao Corp.), 186.7 g of an anionic surfactant ("NEOPELEX G-15" available from Kao Corp.; 15 wt % aqueous solution of sodium dodecylbenzenesulfonate) and 1,287 g of a potassium hydroxide aqueous solution (as a neutralizing agent; concentration: 5% by weight), and the contents of the pot were melted at 98° C. for 2 h while stirring with a paddle-shaped stirrer at a rate of 200 rpm, thereby obtaining a resin binder mixture. Successively, while stirring with a paddle-shaped stirrer at a rate of 200 rpm, 5,311 g in total of deionized water were added dropwise into the pot at a rate of 28 g/min to prepare a resin emulsion. Finally, the obtained resin emulsion was cooled to room temperature and passed through a wire mesh having a 200 mesh screen (opening: 105 μm) to obtain a dispersion containing a resin component in an amount of 29% by weight. The primary particles of the resin particles in the resulting dispersion bad a volume median particle size ($D_{50}$) of 0.152 μm and a coefficient of variation of particle size distribution (CV value) of 25.8. No residual components remained on the wire mesh. The thus obtained dispersion was mixed with ion-exchanged water to control a resin content therein to 23% by weight, thereby obtaining a colorant-containing resin dispersion B.

Production Example 6

Production of Releasing Agent Dispersion 1

After dissolving 10.71 g of an aqueous solution of dipotassium alkenyl (mixture of hexadecenyl group and octadecenyl group) succinate ("LATEMUL ASK" available from Kao Corp.; effective concentration: 28% by weight) in 1,200 g of deionized water in a 2 L beaker, 300 g of a carnauba wax (available from Kato Yoko Co., Ltd.; melting point: 85° C.) were dispersed in the resulting solution. While maintaining the obtained dispersion at a temperature of 90 to 95° C., the dispersion was subjected to dispersing treatment for 60 min using "Ultrasonic Homogenizer 600W" (available from Nippon Seiki Co., Ltd.) and then cooled to room temperature. The resulting releasing agent emulsified particles had a volume median particle size ($D_{50}$) of 0.512 μm and a coefficient of variation of particle size distribution (CV value) of 42.2. The thus obtained dispersion was mixed with ion-exchanged water to control a wax content therein to 20% by weight, thereby obtaining a releasing agent dispersion 1.

Example 1

Production of Toner

A 5 L three-necked separable flask was charged with 900 g of the dispersion A of resin particles and 300 g of the dispersion 1 of colorant-containing polymer particles at room temperature. Then, while stirring the contents of the flask with a paddle-shaped stirrer at a rate of 100 rpm, 78.7 g of the releasing agent dispersion 1 (wax content: 20% by weight) were added and mixed therein. To the resulting dispersion were added 574 g of a 11.2 wt % ammonium sulfate aqueous solution as an aggregating agent at a rate of 9.6 g/min, and the obtained mixture was further stirred at room temperature for 20 min. Thereafter, the resulting mixed dispersion was heated from room temperature to 50° C. (at a temperature rise rate of 0.25° C./rain) and then held at 50° C. for 2 h, thereby obtaining a dispersion containing aggregated particles composed of the resin binder, the colorant and the releasing agent.

Next, 120 g of the dispersion A of resin particles were added at a rate of 2 g/min to the thus obtained dispersion of aggregated particles maintained at 50° C., and then the resulting mixed dispersion was stirred for 20 min. This procedure was further repeated twice. Then, 120 g of the dispersion A of resin particles and 120 g of a 6.4 wt % ammonium sulfate aqueous solution were simultaneously added at a rate of 2 g/min through different ports of the separable flask, and then the resulting dispersion was stirred for 20 min. This procedure was repeated one more time, thereby obtaining 2,621 g of a toner dispersion having a volume median particle size of 4.96 μm and a CV value of 24.7. To the thus obtained toner dispersion were added 37.8 g of "EPOCROS WS-700" (available from Nippon Shokubai Co., Ltd.; content of oxazoline group in oxazoline polymer: 4.55 mmol/g; number-average molecular weight: 20,000; weight-average molecular weight: 40,000; 25% aqueous solution), and the resulting dispersion was stirred for 10 min. Then, 660 g of a 0.63 wt % aqueous solution of an anionic surfactant ("EMAL E27C" available from Kao Corp.; content based on resin: 1% by weight) were added to the dispersion, and the resulting mixture was heated to 77° C. (at a temperature rise rate of 1° C./min) and then held at 77° C. for 1.5 h. The thus obtained particles were cooled and subjected to solid-liquid separation by Nutsche-type suction filtration, and the solid components thus separated were washed and dried. The resulting toner particles were subjected to external addition treatment in which 2.5 parts of a hydrophobic silica ("RY50" available from Nippon Aerosil Co., Ltd.; number-average particle size: 0.04 μm) and 1.0 part of a hydrophobic silica ("CAB-O-SIL TS-720" available from Cabot Corp.; number-average particle size: 0.012 μm) were externally added to 100 parts by weight of the toner particles using a Henschel mixer. The resulting particles were then allowed to pass through a 150 mesh sieve to separate the fine particle capable of passing through the sieve therefrom, thereby obtaining a cyan toner. The thus obtained cyan toner bad a volume median particle size of 5.1 μm and a CV value of 22.0.

Example 2

The same procedure as in Example 1 was repeated except for using the dispersion 2 of colorant-containing polymer particles in place of the dispersion 1 of colorant-containing polymer particles used in Example 1, thereby obtaining a cyan toner. The thus obtained cyan toner had a volume median particle size of 5.0 μm and a CV value of 21.2.

Comparative Example 1

The same procedure as in Example 1 was repeated except for using a self-dispersible cyan pigment "CAB-O-JET 250C" (functional group: sulfonic acid group) available from Cabot Corp., in place of the dispersion 1 of colorant-containing polymer particles used in Example 1, thereby obtaining a cyan toner. The thus obtained cyan toner had a volume median particle size of 5.0 μm and a CV value of 21.2.

Comparative Example 2

The same procedure as in Example 1 was repeated except for using the colorant water dispersion A in place of the dispersion 1 of colorant-containing polymer particles used in Example 1, thereby obtaining a cyan toner. The thus obtained cyan toner had a volume median particle size of 5.2 μm and a CV value of 22.

Comparative Example 3

The same procedure as in Example 1 was repeated except for using 1200 g of the colorant-containing resin dispersion B in place of 900 g of the resin water dispersion A and 300 g of the dispersion 1 of colorant-containing polymer particles both used in Example 1, thereby obtaining a cyan toner. The thus obtained cyan toner had a volume median particle size of 5.1 μm and a CV value of 21.5.

Comparative Example 4

The same procedure as in Example 1 was repeated except for using 1200 g of the dispersion 1 of colorant-containing polymer dispersion in place of 900 g of the resin water dispersion A and 300 g of the dispersion 1 of colorant-containing polymer particles both used in Example 1, thereby obtaining a cyan toner. However, the particle size of the aggregated particles became too large upon the aggregation, and it was difficult to control the particle size, thereby failing to obtain toner particles.

The respective toners thus produced were measured for image density thereof by the following method. In addition, the amount of each toner required for attaining a reflection image density of 1.4 was measured. The results are shown in Table 3. In Examples 1 to 3, it was possible to obtain a high image density even when the toner was used in a small amount.

[Measurement of Image Density]

The respective toners were loaded to a commercially available printer ("ML5400" available from Oki Data Corporation), and a solid image of 40 mm×30 mm having a toner deposition amount of 0.45±0.03 mg/cm$^2$ was formed on a plain paper ("P Paper" available from Fuji Xerox Corp.; size: A4) in a non-fused state by adjusting a developing bias thereof. Using a fuser mounted on the commercially available printer ("ML5400" available from Oki Data Corporation) which had been modified so as to allow fusing of toner images in an off-line mode, the thus obtained solid image was fused at 160° C. at a fusing rate of 40 sheets/min (longitudinal direction of A4). The thus fused solid image was placed on 30 sheets of the P Paper to measure a reflection image density thereof using a colorimeter ("SpectroEye" available from Gretag-Macbeth Corp.) under the irradiating conditions of a standard light source $D_{50}$ and an observation visual field of 2° according to a DIN NB density standard and a standard based on absolute white color.

[Toner Deposition Amount]

The developing bias was adjusted such that an image density of the obtained solid image was fallen within the range of 1.40±0.03. The amount of the toner deposited on a paper was determined by subtracting a weight of a virgin paper from a weight of the paper on which the toner was deposited.

TABLE 3

| | | | Examples | | Comparative Examples | | | |
|---|---|---|---|---|---|---|---|---|
| | | | 1 | 2 | 1 | 2 | 3 | 4 |
| Combination of dispersions | Dispersion of colorant-containing polymer particles | Dispersion 1 of colorant-containing polymer particles | ○ | | | | | ○ |
| | | Dispersion 2 of colorant-containing polymer particles | | ○ | | | | |
| | Self-dispersible colorant | | | | ○ | | | |
| | Colorant water dispersion A | | | | | ○ | | |
| | Colorant-containing resin dispersion B | | | | | | ○ | |
| | Dispersion of resin particles | Dispersion A of resin particles | ○ | ○ | ○ | ○ | ○ | |
| Image density | Image density at a toner deposition amount of 0.4 mg/cm$^2$ | | 1.45 | 1.40 | 1.02 | 0.81 | 1.07 | Not producible |
| Toner deposition amount | Toner deposition amount required for attaining an image density of 1.40 (mg/cm$^2$) | | 0.24 | 0.25 | 0.65 | 0.69 | 0.59 | — |

Note
○ Indicating use or respective dispersions

The SP values of the respective polymers are shown below.

SP Value ((cal/cm$^3$)$^{1/2}$)

Polyester A: 9.8

Polyester B: 10.0

Resin binder: 9.9

$$(=9.8\times980+10.0\times1820)/(980+1820)$$

Polymer used in dispersion 1 of colorant-containing polymer particles: 9.2

Polymer used in dispersion 2 of colorant-containing polymer particles: 8.7

The difference between the SP values of the polymers used in the resin binder and the dispersion of colorant-containing polymer particles (ΔSP: (cal/cm$^3$)$^{1/2}$) was as follows.

ΔSP: 9.9−9.2=0.7 (Example 1)

ΔSP: 9.9−8.7=1.2 (Example 2)

From Table 3, it was confirmed that the polymer compositions of Examples 1 and 2 exhibited a high image density. The reason for exhibiting the high image density even when the amount of the respective toners deposited was small is considered to be that the difference between the SP values of the polymers used in the resin binder and the dispersion of colorant-containing polymer particles was 5 or less.

Industrial Applicability

According to the production process of the present invention, the resulting toner is considerably improved in image density owing to a high dispersibility of a colorant therein. Therefore, the toner of the present invention can be suitably employed as a toner for electrophotography for use in electrophotographic method, electrostatic recording method, electrostatic printing method or the like.

The invention claimed is:

1. A process for producing a toner for electrophotography, comprising mixing a dispersion of pigment-containing polymer particles operable as a colorant with a dispersion of resin particles comprising a polyester and substantially no colorant to aggregate the pigment-containing polymer particles and the resin particles, wherein the pigment-containing polymer particles comprise a vinyl polymer that comprises a constitutional unit of an unsaturated carboxylic acid monomer (a) and a constitutional unit of an aromatic ring-containing monomer (b), wherein monomers of the polyester comprise $C_2$ to $C_3$ alkylene oxide adducts of bisphenol A, having an average molar number of addition of 1 to 16, as an alcohol component, wherein the dispersion of the resin particles containing substantially no colorant is obtained by adding an aqueous alkali solution to the resin to disperse the resin in an aqueous medium, and wherein the dispersion of resin particles comprising a polyester and substantially no colorant additionally comprises an oxazoline group-containing compound as a crosslinking agent in an amount of 10 parts by weight or less based on 100 parts by weight of the resin particles.

2. The process for producing a toner for electrophotography according to claim 1, wherein the vinyl polymer constituting the polymer particles is a graft polymer, which further comprises a constitutional unit of a hydrophobic monomer (c) in a side chain.

3. The process for producing a toner for electrophotography according to claim 1, wherein the aromatic ring-containing monomer (b) is a benzyl(meth)acrylate.

4. The process for producing a toner for electrophotography according to claim 1, wherein a difference between a solubility parameter (SP value) of a resin forming the resin particles containing substantially no colorant and a solubility parameter (SP value) of the polymer constituting the pigment-containing polymer particles is 5 or less.

5. A toner for electrophotography which is produced by the process as defined in claim 1.

6. The process for producing a toner for electrophotography according to claim 1, wherein the dispersion of pigment-containing polymer particles is produced by a method comprising:

dispersing a mixture comprising a water-insoluble polymer, organic solvent, neutralizing agent, colorant, and water to obtain a dispersion, and removing the organic solvent from the dispersion; and wherein the dispersion of resin particles is produced by a method comprising:

dispersing a resin in water having substantially no organic solvent.

7. The process for producing a toner for electrophotography according to claim 1, wherein a dispersion is obtained by said mixing and said process further comprises:

adding resin fine particles to the dispersion and coalescing the aggregated particles.

8. The process for producing a toner for electrophotography according to claim 1, further comprising:

aggregating the pigment-containing polymer particles and the resin particles in the presence of a monovalent salt.

9. The process for producing a toner for electrophotography according to claim 8, wherein the monovalent salt is a water-soluble nitrogen-containing compound having a molecular weight of 350 or less.

10. The process for producing a toner for electrophotography according to claim 1, wherein the polymer constituting the pigment-containing polymer particles comprises a constitutional unit of a nonionic (meth)acrylate-based monomer (d).

11. The process for producing a toner for electrophotography according to claim 10, wherein the nonionic (meth)acrylate-based monomer is a nonionic monomer represented by the following formula (3):

$$CH_2{=}C(R^5)COO(R^6O)_nR^7 \quad (3)$$

wherein $R^5$ is a hydrogen atom or an alkyl group having 1 to 3 carbon atoms; $R^6$ is an alkylene group having 2 to 18 carbon atoms; n represents an average molar number of addition and is a number of 1 to 30; and $R^7$ is a hydrogen atom, an alkyl group having 1 to 18 carbon atoms or a phenyl group which may be substituted with an alkyl group having 1 to 8 carbon atoms.

12. The process for producing a toner for electrophotography according to claim 2, wherein the content of a constitutional unit of a styrene-based monomer in a side chain of the polymer constituting the pigment-containing polymer particles is 60% by weight or larger.

13. The process for producing a toner for electrophotography according to claim 1, wherein the volume median particle size ($D_{50}$) of the pigment-containing polymer particles is from 0.05 to 0.2 μm.

14. The process for producing a toner for electrophotography according to claim 1, wherein the content of a polyester in a resin binder forming the resin particles is substantially 100% by weight.

15. The process for producing a toner for electrophotography according to claim 1, wherein in dispersing the resin in the aqueous medium, a nonionic surfactant and an anionic surfactant are present in the dispersion of the resin particles.

16. The process for producing a toner for electrophotography according to claim 1, wherein the content of the pigment in the pigment-containing polymer is from 3 to 30 parts by weight on the basis of 100 parts by weight of a resin binder forming the pigment-containing polymer particles and the resin particles.

17. The process for producing a toner for electrophotography according to claim 7, wherein the mixing ratio of the resin particles to the resin fine particles (resin particles/resin fine particles) is from 0.1 to 2.0 in terms of a weight ratio.

18. The process for producing a toner for electrophotography according to claim 7, wherein the temperature in coalescing the aggregated particles formed by a resin binder is not lower than the glass transition point of the resin binder +(plus) 5° C. and not higher than the softening point of the resin binder +(plus) 15° C.

19. The process for producing a toner for electrophotography according to claim 1, wherein the amount of the oxazoline group-containing compound is 0.1 to 5 parts by weight or less based on 100 parts by weight of the resin particles.

* * * * *